US006680566B2

(12) United States Patent
Hergott et al.

(10) Patent No.: US 6,680,566 B2
(45) Date of Patent: Jan. 20, 2004

(54) TELEVISION CATHODE RAY TUBE

(75) Inventors: Stefan Hergott, Wiesbaden (DE); Michael Vogel, Mainz (DE); Volker Knoche, Mainz (DE); Ralf Kehlenbeck, Stadecken-Elsheim (DE); Oliver Mühlke, Eltville (DE)

(73) Assignee: Schott Glas, Mainz (DE)

( * ) Notice: Subject to any disclaimer, the term of this patent is extended or adjusted under 35 U.S.C. 154(b) by 182 days.

(21) Appl. No.: 10/023,462

(22) Filed: Dec. 17, 2001

(65) Prior Publication Data

US 2002/0153823 A1 Oct. 24, 2002

(30) Foreign Application Priority Data

Dec. 18, 2000 (DE) ..... 100 63 034

(51) Int. Cl.[7] ..... H01J 1/62
(52) U.S. Cl. ..... 313/477 R; 313/495; 313/493
(58) Field of Search ..... 313/477 R, 495, 313/493

(56) References Cited

U.S. PATENT DOCUMENTS 4,788,471 A 11/1988 Strauss

FOREIGN PATENT DOCUMENTS

DE 2407527 8/1975

*Primary Examiner*—Vip Patel
(74) *Attorney, Agent, or Firm*—Nils H. Ljungman & Associates

(57) ABSTRACT

There is now provided a television cathode ray tube having a faceplate, an electron gun means, and a glass funnel to configure the cathode ray tube as a wide-angle, shallow-depth, implosion-resistant television cathode ray tube. The glass funnel has a solder edge, a funnel throat, a parabolic area and a funnel body and the external contour between the solder edge and the parabolic area along a first section which is defined by the direction of the diagonal of the television glass funnel is essentially a steeply descending straight line, along a second section which is defined by the direction of the major axis of the television glass funnel, is essentially a flat descending straight line, which descends steeply in a curve in the area of the solder edge, and along a third section which is defined by the direction of the small axis of the television glass funnel, is essentially a steeply descending straight line. The glass funnel is configured to minimize the height of the television cathode ray tube to position said deflection coil arrangement at a distance from the shadow mask to minimize errors of electron beams, to minimize the weight of the television cathode ray tube, and to minimize risk of implosion.

19 Claims, 12 Drawing Sheets

TELEVISION CATHODE RAY TUBE

BACKGROUND OF THE INVENTION

1. Field of the Invention

This invention relates to a television cathode ray tube.

2. Background Information

In simple terms, a cathode ray tube is lined with a phosphorous material that glows when it is struck by a stream of electrons. This material is arranged into an array of millions of tiny cells, usually called dots. At the back of the cathode ray tube is a set of electron guns, which produce a controlled stream of electrons, much as the name implies. To produce a picture on the screen, these guns start at the top of the screen and scan very rapidly from left to right. Then, they return to the leftmost position one line down and scan again, and repeat this to cover the entire screen. In performing this scanning or sweeping type motion, the electron guns are controlled by the data stream coming into the cathode ray tube, which varies the intensity of the electron beam at each position on the screen. This control of the intensity of the electron beam at each dot is what controls the color and brightness of each pixel on the screen. This all happens extremely quickly, and in fact the entire screen is drawn in a small fraction of a second.

There are three electron guns that control the display of red, green and blue light respectively. The surface of the cathode ray tube is arranged to have these dots placed adjacently in a specific pattern. In a monitor, there are separate video streams for each color coming from the video card, which allows the different colors to have different intensities at each point on the screen. By varying the intensity of the red, green and blue streams, the full rainbow of colors is made possible.

The surface of the cathode ray tube only glows for a small fraction of a second before beginning to fade. This means that the cathode ray tube must redraw the picture many times per second to avoid having the screen flicker as it begins to fade and then is renewed. This rapid redrawing is called "refreshing" the screen.

Thus, a cathode ray tube is a special-purpose electron tube in which electrons are accelerated by high-voltage anodes, formed into a beam by focusing electrodes, and projected toward a phosphorescent screen that forms one face of the tube. The beam of electrons leaves a bright spot wherever it strikes the phosphor screen. To form a display, or image, on the screen, the electron beam is deflected in the vertical and horizontal directions either by the electrostatic effect of electrodes within the tube or by magnetic fields produced by coils located around the neck of the tube. Some cathode-ray tubes can produce multiple beams of electrons and have phosphor screens that are capable of displaying more than one color.

Thus, television cathode ray tubes consist of a television glass funnel which, together with the screen or television screen, forms the evacuated space of the cathode ray tube.

In other words, a matching faceplate is secured at the forward portion of the glass funnel. The faceplate may be dimensioned to comprise or accommodate, for example, a 16:9 screen aspect ratio, that is, the ratio of the screen width to screen height, or width:height. Still in other words, the ratio of width to height is often quoted when dealing with different methods of movie presentation. A standard TV screen has a ratio of 4:3, i.e., for every 4 units wide it is 3 units high. This ratio is sometimes quoted as 1.33:1 which is exactly the same as 4:3. Widescreen TVs are obviously wider and their screens have a ratio of 16:9, i.e., for every 16 units wide they are 9 units high. This ratio is the same as 1.78:1.

The television glass funnel itself is divided into three regions: the funnel throat, which contains the electron beam gun and is oriented cylindrically, or is essentially cylindrical, the parabolic area, around which the deflection coil to guide the electron beam is located and which generally has a round surface with a widening cross section; and the funnel body, the cross section surface of which increases steadily and generally makes a transition from a round or oval shape into a rectangular shape, until the cross section surface of the screen is reached. The television glass funnel and screen are connected to each other by means of contact surfaces, which are designated solder edges below.

In other words, the television glass funnel as such is divided into three regions or portions: the funnel throat portion, which contains the electron beam gun and is configured to be a hollow cylinder; the hollow transition portion, around which the deflection coil or like yoke arrangement to magnetically guide the electron beams is located and which transition portion generally has a cylindrically configured, round surface with a widening cross section; and the funnel body, the cross section surface or area of which increases steadily and, generally, makes a transition from a round shape, or oval shape, into a rectangular shape, until the cross section surface or area matches that of the of the screen or faceplate. The television glass funnel and the glass screen or faceplate are connected to one another by way of matching contact surfaces, or contact portions, which are referred to as solder edges, or solder edge portions, below.

The term "rectangular" as used here and below is understood as a surface that essentially describes a rectangular shape, and the corners of which can be rounded. Corresponding to the rectangular shape of the screen, the surface of the area that is painted by the electron beam is also rectangular.

In other words, the term "rectangular" as used herein is to be understood to refer to a surface or configuration that essentially describes a rectangular shape or configuration and the corners of which can be rounded, for example. Corresponding to the rectangular shape or configuration of the screen or faceplate, the surface or area thereof onto which the electron gun beam is directed, is also of rectangular configuration.

OBJECT OF THE INVENTION

The object of one embodiment of the invention is to find a cathode ray tube which has a shape that is shorter than the prior art devices, i.e. one that has a smaller depth or height upon installation.

The object of at least one embodiment is to configure a cathode ray tube with a weight as low as possible.

The object of at least one embodiment is to configure a cathode ray tube to be implosion-proof.

The object of one embodiment of the invention is to find a television glass funnel for a television cathode ray tube which has a shape that is shorter than the funnel that is used in similar devices of the prior art, i.e. one that has a smaller depth. The weight of the funnel must also be as low as possible, and it must also be implosion-proof.

SUMMARY OF THE INVENTION

The invention, in at least one embodiment, teaches a wide-angle, shallow-depth, implosion-resistant television cathode ray tube, comprising: a glass faceplate; the faceplate comprising a substantially flat faceplate with a first surface which becomes an outer surface and substantially the viewing area of the television tube upon installation in a television set, and with a second surface opposite the first surface; the faceplate being configured and dimensioned for a display width of sixteen units and for a display height of nine units; a phosphor screen disposed adjacent to the second surface, being configured to be responsive to electron beams incident thereon, and being configured to emit visible light on the first surface of the faceplate when excited by electron beams; a shadow mask disposed adjacent to the phosphor screen and being configured with apertures configured to permit passage of electron beams therethrough; an electron gun means disposed at a distance away from the shadow mask and being configured to emit electron beams through the apertures of the shadow mask; a glass funnel; the glass funnel comprising (a.), (b.), (c.), (d.), and (e.), where (a.), (b.), (c.), (d.), and (e.) are: (a.) a solder edge portion; the solder edge portion being soldered to the faceplate; the solder edge portion comprising a substantially rectangular solder edge portion and being dimensioned for a display width of sixteen units and a display height of nine units; (b.) a cylindrical funnel throat portion configured to mount the electron gun means therein; (c.) a funnel body portion comprising a truncated substantially pyramidal funnel body portion; (d.) a parabolic transition portion being disposed between the cylindrical funnel throat portion and the pyramidal funnel body portion and forming a funnel throat transition portion; and (e.) a curved transition portion being disposed between the pyramidal funnel body portion and the solder edge portion and forming a solder edge transition portion; the solder edge portion having a pair of substantially parallel, vertical, solder edges which respectively become a right vertical solder edge and a left vertical solder edge upon installation of the glass funnel in a television set, and the solder edge portion having a pair of substantially parallel, horizontal, solder edges which respectively become an upper solder edge and a lower solder edge upon installation of the glass funnel in a television set; the upper solder edge being connected with the vertical solder edges to form an upper, right, solder edge corner and an upper, left, solder edge corner upon installation of the glass funnel in a television set; the lower solder edge being connected with the vertical solder edges to form a lower, right, solder edge corner and a lower, left, solder edge corner; the upper, right, solder edge corner and the lower, left, solder edge corner defining a first diagonal plane being disposed substantially perpendicular to the faceplate and being disposed between the upper, right, solder edge corner and the lower, left, solder edge corner; the upper, left, solder edge corner and the lower, right, solder edge corner defining a second diagonal plane being disposed substantially perpendicular to the faceplate and being disposed between the upper, left, solder edge corner and the lower, right, solder edge corner; the pair of vertical solder edges comprising respective midpoints, the midpoints being disposed substantially equidistant from the pair of horizontal solder edges, and the midpoints defining a horizontal plane being disposed substantially perpendicular to the faceplate; the pair of horizontal solder edges comprising respective midpoints, the midpoints being disposed substantially equidistant from the pair of vertical solder edges, and the midpoints defining a vertical plane being disposed substantially perpendicular to the faceplate; an intersection between the horizontal plane and the pyramidal funnel body portion defining a right horizontal straight linear portion on the right surface of the pyramidal funnel body portion, and a left horizontal straight linear portion on the left surface of the pyramidal funnel body portion; an intersection between the vertical plane and the pyramidal funnel body portion defining an upper, vertical, straight linear portion on the upper surface of the pyramidal funnel body portion, and defining a lower, vertical, straight linear portion on the lower surface of the pyramidal funnel body portion; an intersection between the first diagonal plane and the pyramidal funnel body portion defining a diagonal, right, upper straight linear portion on the upper surface of the pyramidal funnel body portion, and defining a diagonal, left, lower straight linear portion on the lower surface of the pyramidal funnel body portion; an intersection between the second diagonal plane and the pyramidal funnel body portion defining a diagonal, left, upper straight linear portion on the upper surface of the pyramidal funnel body portion, and defining a diagonal, right, lower straight linear portion on the lower surface of the pyramidal funnel body portion; all of the straight linear portions extending from the funnel throat transition portion to the solder edge transition portion; an intersection between the horizontal plane and the solder edge transition portion defining a first, horizontal, height from the solder edge portion to a portion of each corresponding horizontal straight linear portion being closest to the solder edge portion; an intersection between the vertical plane and the solder edge transition portion defining a second, vertical, height, from the solder edge portion to a portion of each corresponding vertical straight linear portion being closest to the solder edge portion; an intersection between each the diagonal plane and its corresponding solder edge transition portion defining a third, diagonal, height, from the solder edge portion to a portion of each corresponding diagonal straight linear portion being closest to the solder edge portion; the first, horizontal, height being greater than either the second, vertical, height or the third, diagonal, height; the horizontal straight linear portion on the right surface of the pyramidal funnel body portion, and the horizontal straight linear portion on the left surface of the pyramidal funnel body portion each having a first, horizontal, slope; the upper straight linear portion on the upper surface of the pyramidal funnel body portion, and the lower straight linear portion on the lower surface of the pyramidal funnel body portion each having a second, vertical, slope; the diagonal, right, upper straight linear portion on the upper surface of the pyramidal funnel body portion, the diagonal, left, lower straight linear portion on the lower surface of the pyramidal funnel body portion, the diagonal, left, upper straight linear portion on the upper surface the pyramidal funnel body portion, and the diagonal, right, lower straight linear portion on the lower surface of the pyramidal funnel body portion all having a third, diagonal, slope; the steepness of the horizontal slope being shallower than either the steepness of the vertical slope or the steepness of the diagonal slope; the steepness of the diagonal slope being shallower than the steepness of the vertical slope; the first, horizontal, height from the solder edge portion to the portion of each corresponding horizontal straight linear portion being closest to the solder edge portion, being sufficiently great to dispose and configure each of the horizontal straight linear portions to have the shallowest slope of all of the straight linear portions; the television cathode ray tube further comprising: a deflection coil arrangement disposed about the parabolic transition portion and configured to deflect electron beams in a timed manner across the faceplate; an internal coating on the pyramidal funnel body portion, the coating comprising a conductive coating; and an arrangement configured and disposed to a supply a high voltage electron accelerating potential from a power supply to the internal coating; the glass funnel thus being configured to minimize the height of the pyramidal funnel body portion and thus to permit to position the deflection coil arrangement at a distance from the shadow mask to minimize errors of electron beams; minimize the weight of the glass funnel; and minimize risk of implosion; and to thus form a wide-angle, shallow-depth, implosion-resistant television cathode ray tube.

The invention teaches, at least in one embodiment, a wide-angle, shallow-depth cathode ray tube comprising: a glass faceplate; the faceplate comprising a substantially flat faceplate with a first surface which becomes an outer surface and substantially the viewing area of the cathode ray tube upon installation, and with a second surface opposite the first surface; a phosphor screen being disposed adjacent to the second surface, being configured to be responsive to electron beams incident thereon, and being configured to emit visible light on the first surface of the faceplate when excited by electron beams; an electron gun means being disposed at a distance away from the phosphor screen and being configured to emit electron beams; and a wide-angle, shallow-depth glass funnel; the glass funnel comprising (a.), (b.), (c.), (d.), and (e.), where (a.), (b.), (c.), (d.), and (e.) are: (a.) a solder edge portion; the solder edge portion being soldered to the faceplate, the solder edge portion comprising a substantially rectangular solder edge portion; (b.) a cylindrical funnel throat portion having the electron gun means mounted therein; (c.) a funnel body portion comprising a truncated substantially pyramidal funnel body portion, the pyramidal funnel body portion defining a central axis being disposed substantially perpendicular to the solder edge portion, and the pyramidal funnel body portion comprising an outer surface; (d.) a first transition portion being disposed between the cylindrical funnel throat portion and the pyramidal funnel body portion and forming a funnel throat transition portion; and (e.) a second transition portion being disposed between the pyramidal funnel body portion and the solder edge portion and forming a solder edge transition portion; the solder edge portion having a first solder edge and a second solder edge joined to the first solder edge; the first solder edge and the second solder edge being connected to one another at a corner; the first solder edge comprising a first length, the first length comprising a first midpoint, the first midpoint and the central axis defining a first plane being disposed substantially perpendicular to the solder edge portion; the second solder edge comprising a second length comprising a second midpoint, the second midpoint and the central axis defining a second plane being disposed substantially perpendicular to the solder edge portion; the corner and the central axis defining a third plane being disposed substantially perpendicular to the solder edge portion; the intersection between the first plane and the pyramidal funnel body portion defining a first straight linear portion being disposed on the outer surface of the pyramidal funnel body portion; the intersection between the second plane and the pyramidal funnel body defining a second straight linear portion on the outer surface of the pyramidal funnel body portion; the intersection between the third plane and the pyramidal funnel body portion defining a third straight linear portion on the outer surface of the pyramidal funnel body portion; all of the straight linear portions extending from the funnel throat transition portion to the solder edge transition portion; the intersection of the first plane and the solder edge transition portion defining a first height from the solder edge portion to a portion of the first straight linear portion being closest to the solder edge portion; the intersection of the second plane and the solder edge transition portion defining a second height from the solder edge portion to a portion of the second straight linear portion being closest to the solder edge portion; the intersection of the third planes and the solder edge transition portion defining a third height from the solder edge portion to a portion of the third straight linear portion being closest to the solder edge portion; the first height, from the solder edge portion to the portion of the first straight linear portion being closest to the solder edge portion, being greater than either the second height or the third height and being sufficiently great to dispose and configure the first straight linear portion to have the shallowest slope of all of the three straight linear portions; the glass funnel thus being configured to minimize the height of the funnel body portion; and to thus configure a wide-angle, shallow-depth, cathode ray tube.

The invention further teaches, in at least one embodiment, a glass funnel for a cathode ray tube, the glass funnel comprising: (a.) a solder edge structure; the solder edge structure being configured to receive a faceplate for a cathode ray tube and the solder edge structure defining a solder edge plane thereat; (b.) a cylindrical funnel throat configured to mount therein electron gun means of a cathode ray tube; (c.) a funnel body; the funnel body having an outer surface and the funnel body defining a central axis being disposed substantially perpendicular to the solder edge plane; (d.) a first, funnel throat, transition portion disposed between the cylindrical funnel throat and the funnel body; and (e.) a second, solder edge, transition portion disposed between the funnel body and the solder edge structure; the solder edge structure having a first substantially linear solder edge and a second substantially linear solder edge joining the first substantially linear solder edge; the first substantially linear solder edge being disposed transverse to the second substantially linear solder edge; the first substantially linear solder edge and the second substantially linear solder edge being connected to one another at a corner; the first substantially linear solder edge comprising a first length comprising a first midpoint; a first region extending from the first midpoint towards the central axis across the solder edge transition portion and across the funnel body to the funnel throat transition portion; the first region comprising a first substantially straight linear portion being disposed on the outer surface of the funnel body; the second substantially linear solder edge comprising a second length comprising a second midpoint; a second region extending from the second midpoint towards the central axis across the solder edge transition portion and across the funnel body to the funnel throat transition portion; the second region comprising a second substantially straight linear portion being disposed on the outer surface of the funnel body; a third region extending from the corner towards the central axis across the solder edge transition portion and across the funnel body to the funnel throat transition portion; the third region comprising a third, diagonal, substantially straight linear portion being disposed on the outer surface of the funnel body; all of the substantially straight linear portions extending substantially from the funnel throat transition portion to substantially the solder edge transition portion.

The invention, in one embodiment, teaches that this object is achieved by a television glass funnel 10 for a television cathode ray tube with a solder edge 7, which on the front surface that faces the viewer is essentially rectangular, a funnel throat 1, a parabolic area 2, and a funnel body 8, characterized by the fact that the external contour between the solder edge 7 and the parabolic area 2 along a section C—C which is defined by the direction of the diagonal 3.1 of the television glass funnel 10, is essentially a steeply descending straight line, along a section A—A, which is defined by the direction of the major axis 3.2 of the television glass funnel 10, is essentially a flat, or relatively flat, or more gently sloped, descending straight line, which descends sharply in a curve shape in the area of the solder edge 7, and along the section B—B which is defined by the direction of the minor axis 3.3 of the television glass funnel 10, is essentially a steeply descending straight line.

Advantageous developments are disclosed in the dependent claims.

The above-discussed embodiments of the present invention will be described further hereinbelow. When the word "invention" is used in this specification, the word "invention" includes "inventions", that is the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The various embodiments of the invention are explained in greater detail below with reference to the exemplary embodiments which are illustrated in the accompanying drawings, in which.

DESCRIPTION OF THE PREFERRED EMBODIMENT

Figure 2:
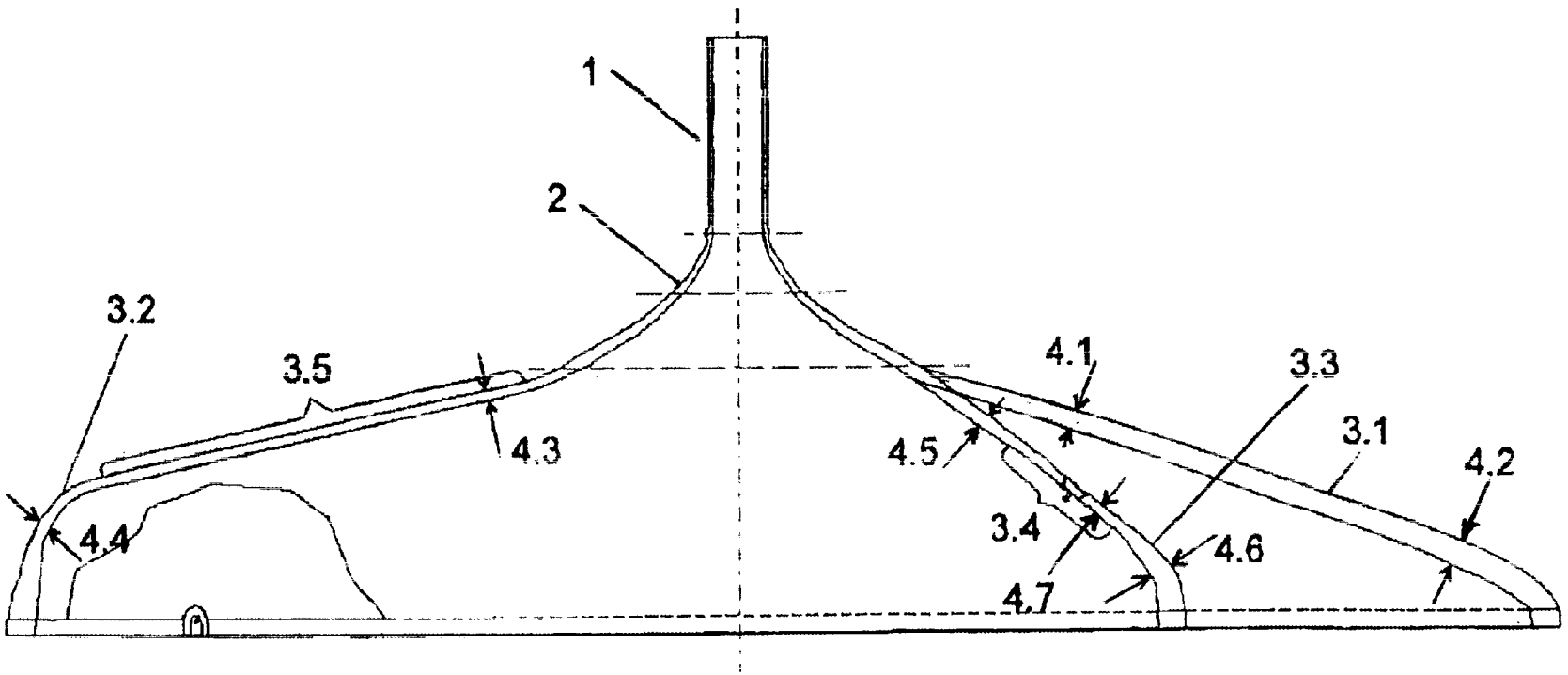
FIG. 2 shows a television glass funnel in a side view with the respective sections.

The television glass funnel (10) illustrated in FIG. 2 for a television cathode ray tube for soldering with a screen consists essentially of a funnel throat (1), a parabolic area (2), a funnel body (8) and a solder edge (7). The external contour between the solder edge (7) and the parabolic area (2) along a section C—C that is defined by the direction of the diagonal (3.1) of the television glass funnel (10), is essentially a steeply descending straight line.

The external contour between the solder edge (7) and the parabola area (2) along the section B—B which is defined by the direction of the minor axis (3.3) of the television glass funnel (10) is likewise essentially a steeply descending straight line.

The path of the external contour between the solder edge (7) and the parabola area (2) along a section A—A which is defined by the direction of the major axis (3.2) of the television glass funnel (10) is essentially a flat, or relatively flat, or more gently sloped, descending straight line. In the vicinity of the solder edge (7), the straight line descends steeply in a curved shape.

The curved descent of the straight line in the vicinity of the solder edge (7) is less along the minor axis (3.3) and is the least pronounced along the diagonal (3.1).

As shown in FIG. 2, the steepness, or slope, or inclination, of the respective external contour or the steepness of the respective straight lines is thereby as follows: Steepness of the minor axis (3.3)>>Steepness of the diagonal (3.1) >Steepness of the major axis (3.2).

Along the diagonal (3.1), the wall thicknesses (4.1, 4.2) are essentially, significantly greater than the wall thicknesses (4.3, 4.4) in the area (3.5) along the major axis (3.2).

Along the minor axis (3.3), the wall thicknesses (4.5, 4.6) are essentially, significantly greater than along the major axis (3.2), whereby the wall thickness (4.7) in the area (3.4) between approximately ¼ of the height and ½ of the height above the solder edge (7) is less than the wall thicknesses (4.5, 4.6). The height is measured between the solder edge (7) and the beginning of the parabola area (2) (height of the funnel body (8)).

The wall thickness in the vicinity of the solder edge (7) is greater than the wall thickness in the vicinity of the funnel body (8).

The terms "thinner" and "thicker" refer to the average wall thicknesses in the overall funnel body (8).

The term "rectangular" as used here and below is understood as a surface that essentially describes a rectangular shape, and the corners of which can be rounded. Corresponding to the rectangular shape of the screen, the surface of the area that is painted by the electron beam is also rectangular.

In other words, the term "rectangular" as used herein is to be understood to refer to a surface or configuration that essentially describes a rectangular shape or configuration and the corners of which can be rounded, for example. Corresponding to the rectangular shape or configuration of the screen or faceplate, the surface or area thereof onto which the electron gun beam is directed, is also of rectangular configuration.

The terms "right" and left" herein refer to the position of a viewer in front of a television.

As a result of the distribution of wall thicknesses described above, the maximum allowable stresses are not exceeded. The thinner major axis (3.2) together with the other two thicker axes (3.1, 3.3) reduces the stresses in the parabola area (2). The thin area (3.4) in the minor axis (3.3) leads to a reduction of the stresses, in particular in the vicinity of the solder edge.

Figure 3:
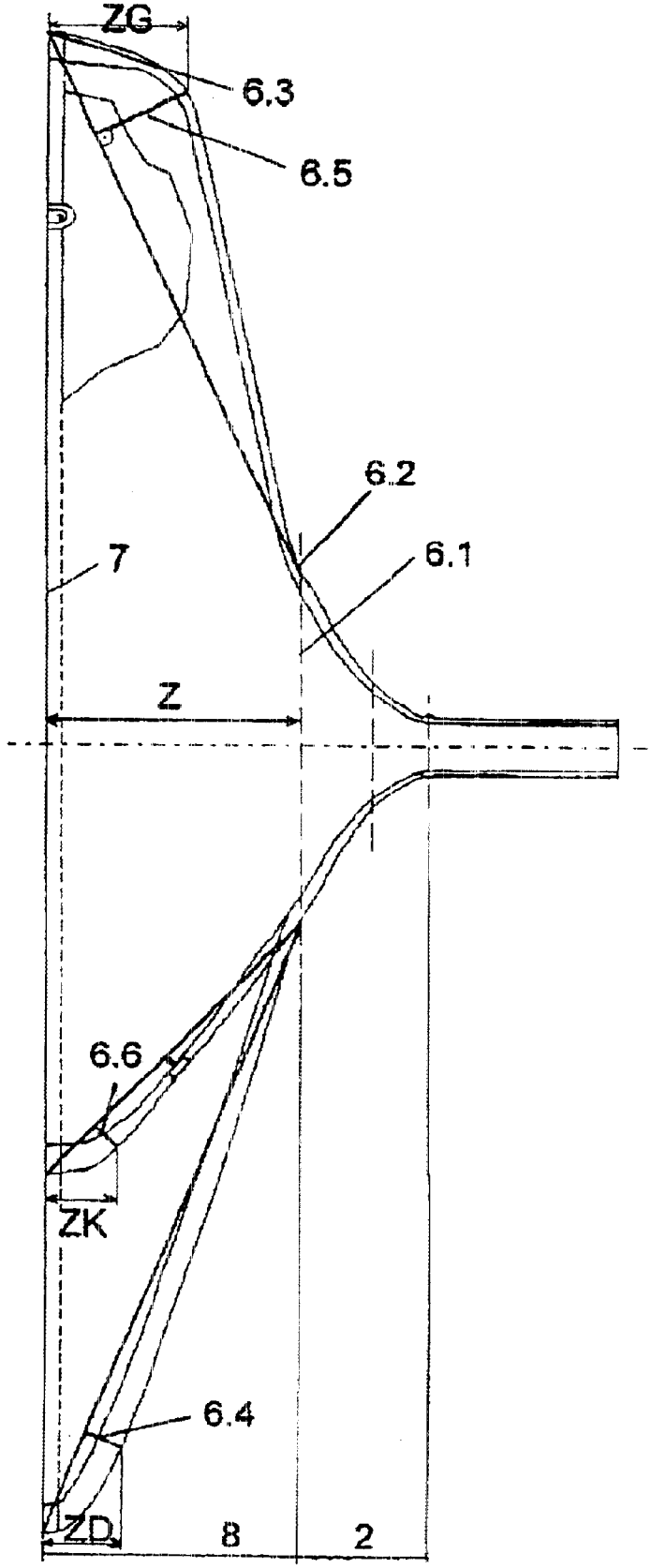
FIG. 3 shows the television glass funnel shown in FIG. 2 with the respective maximum distance H between the respective outer contour and the respective direct connecting lines between the outer edge of the solder edge and the external transition from the funnel body to the parabolic area.

FIG. 3 shows the maximum distance H between the respective external contour and the respective direct connecting line between the outer edge (6.3) of the solder edge and the external transition (6.2) from the funnel body (8) to the parabola area (2). The distance H is measured perpendicular to the connecting line. The height of the intersection between the perpendicular and the external contour above the solder edge (7) is designated Z ($Z_D$ for the diagonal, $Z_K$ for the minor axis and $Z_G$ for the major axis). The ratio of the height of the funnel body (8) Z to the height of the respective maximum distance H is used to describe the curvature of the external contour ($Z/Z_D$, $Z/Z_K$, $Z/Z_G$). If the ratio is large, then the axis of sharply curved.

One embodiment of the invention teaches that the ratio between the maximum distance $H_{dia}$ (6.4) between the external contour along the diagonal (3.1) and the direct line connecting the external edge of the solder edge and the external transition from the funnel body (8) to the parabola area (2) and the diagonal dimension (D) $D/H_{\alpha ia}>28$. The curvature is $Z/Z_D>2.5$.

The ratio between the maximum distance $H_{gr}$ (6.5) to the external contour along the major axis (3.2) and the direct line connecting the outer edge of the solder edge and the outer transition from the funnel body (8) to the parabola area (2) and the diagonal dimension (D) $D/H_{gr}<25$ and the curvature is $Z/Z_G>1.6$. The ratio between the maximum distance $H_{K1}$ (6.6) to the outer contour along the minor axis (3.3) and the direct line connecting the external edge of the solder edge and the external transition from the funnel body (8) to the parabola area (2) and the diagonal dimension (D) $D/H_{k1}>33$, and the curvature $Z/Z_K>2.6$.

In one preferred embodiment of a television glass funnel, the parabola area (2) has a rectangular cross section in at least a partial segment between the connecting points to the funnel throat (1) and to the funnel body (8).

On account of the rectangular cross section, in particular in the central area of the parabola (2), the external contour of the glass on the minor and major axis is brought closer to the center axis of the funnel. The length of the area with a rectangular cross section thereby varies in the range of a centimeter. Because the deflection unit for the electron beam sits directly on the glass external contour, the deflection unit is also brought close to the electron beam which runs inside the funnel. The magnetic field which is built up by the deflection unit to guide the electron beam must therefore overcome a smaller distance and can be less strong, thereby conserving electrical energy.

The greater the distance from the source of a magnetic field becomes, the greater the interval between the field lines also becomes. Then, because the magnetic field lies closer to the electron beam and thus the density of field lines is greater than the density of the field lines in standard parabola areas, the beam can be guided with greater precision.

The television glass funnel (10) is preferably soldered to a screen which has an abbreviated encircling web. The diagonal (3.1) of the funnel (10) is accordingly elongated for a specified screen format. To reduce the stresses in the overall funnel body (8), the solder edge (7) is placed at a height which results in a flatter screen with an abbreviated encircling web. The funnel (10) is thereby enlarged accordingly. The total depth of the cathode ray tube thereby remains unchanged. The funnel shape can therefore make a good transition from the axes (3.1 and 3.2) that run flatter to the solder edge (7).

The ratio of the horizontal (major) axis to the vertical (minor) axis of the screen preferably forms the 16:9 format The deflection angle of the electron beam along the diagonal (3.1) of the television glass funnel (10) is preferably approximately 120°. As a result of the large deflection angle, the funnel is very flat, i.e. the funnel has an abbreviated shape. However, if the funnel design is defined analogous to funnels of the prior art, unacceptably high stresses may possibly result, as can be verified by finite element calculations. It is therefore seemingly not possible to produce implosion-proof cathode ray tubes similar to the prior art tubes.

The abbreviated television glass funnel claimed by one embodiment by the invention, reduces the stresses below the acceptable maximum value, thereby guaranteeing greater protection against implosion. For this purpose, the external contour taught by one embodiment of the invention and explained above is applied to the axes of symmetry (3.2, 3.3) and the diagonal (3.1).

In addition, special wall thicknesses are used, which are described in the major and minor axes (3.2, 3.3) and the diagonal (3.1), which leads to an advantageous reduction in the weight of the funnel.

The line of separation between the screen and the funnel is displaced so that a shorter screen can be used.

Exemplary Embodiment:

For a cathode ray tube with a diagonal of 81 cm (32"), a height/width ratio of approximately 16:9 and with a deflection angle of 120°, the following dimensions can be achieved, for example:

200 mm for the overall height of the funnel from the solder edge to the end of the parabola area.

Wall thicknesses (as illustrated in FIG. 2)

| Item | 4.1 | 4.2 | 4.3 | 4.4 | 4.5 | 4.6 | 4.7 |
|---|---|---|---|---|---|---|---|
| Thickness [mm] | 10 | 12 | 5 | 7 | 8 | 10 | 5 |

The distance from the straight line connection between the solder edge and the beginning of the parabola area is 20 mm in the diagonal, which gives, for the 810 mm long diagonal:

$D/H_{dia}=810/20=40.5$ for the 52 mm distance with the major axis:

$D/H_{gr}=810/52=15.6$ and for the 16 mm distance with the minor axis:

$D/H_{k1}=810/16=50.6$.

On the other hand, for a standard Schott 76FW funnel of the prior art with an 810 mm diagonal, the following ratios are obtained:

$D/H_{dia}=810/51=15.8$ $D/H_{gr}=810/56=14.46$ $D/H_{k1}=810/41=19.75$.

The height of the funnel body Z=132, $Z/Z_D=3.3$ $Z/Z_G=1.85$ $Z/Z_K=3.47$.

For the comparison funnel, Z=208, $Z/Z_D=2.1$ $Z/Z_G=1.65$ $Z/Z_K=3.47$.

Figure 4:
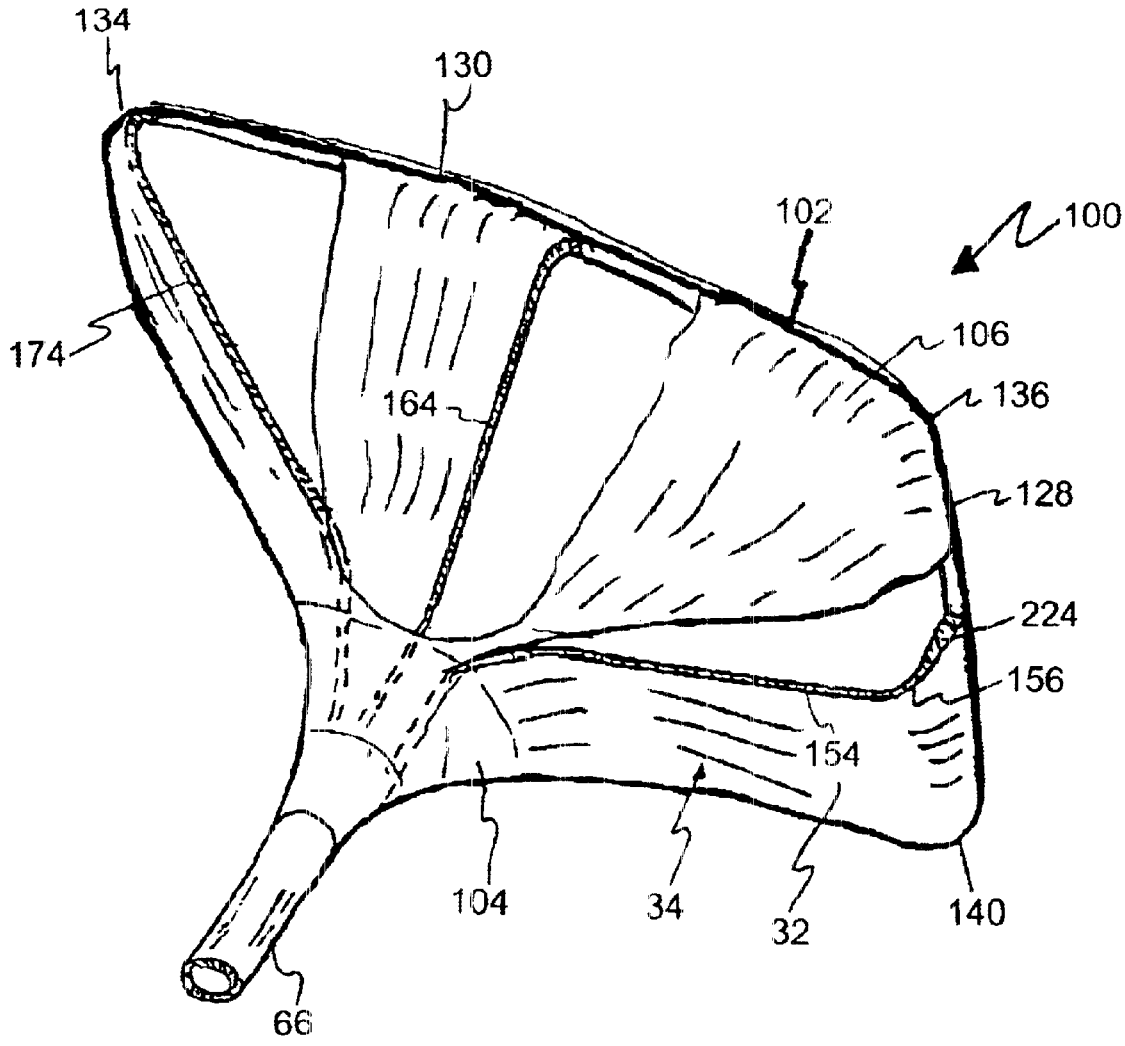
FIG. 4 is a perspective view from the rear of a glass funnel according to one embodiment of the invention.

Referring to FIG. 4, this shows a perspective view from the rear of a glass funnel (100) according to one embodiment of the invention. The funnel body (32) of glass funnel (100) has corners (134, 136, and 140), and an upper solder edge (130) and a left solder edge (128) being parts of a solder edge portion or structure (102). The glass funnel (100) has a first, parabolic or like curved transition portion (104) adjacent a cylindrical funnel throat portion (66) and has a curved transition portion (106) between the funnel body (32) and the solder edge portion. FIG. 4 illustrates a horizontal sloped portion (154) that is connected to a curved portion (156) that connects, by way of a reinforcement (224), to the solder edge portion (102). The FIG. 4 also illustrates a vertical sloped portion (164) and a diagonal slope (174).

Figure 5:
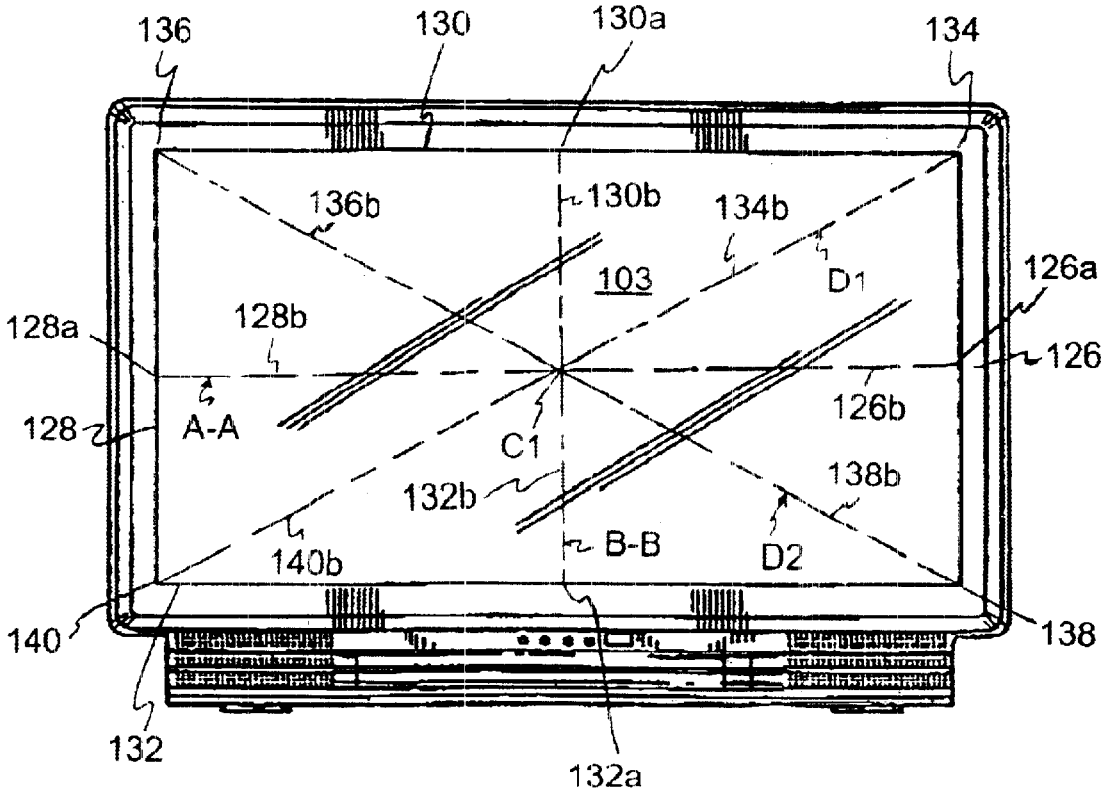
FIG. 5 is an elevation of the front of a television with a cathode ray tube in accordance with one embodiment of the invention.

Referring to FIG. 5, this illustrates a front view of a television showing portions of the funnel body (32). Thus, there is provided a pair of substantially parallel, vertical, solder edges (126, 128) which respectively become a right vertical solder edge (126) and a left vertical solder edge (128) upon installation of the glass funnel (100) in a television set, and a pair of substantially parallel, horizontal, solder edges (130, 132) which respectively become an upper solder edge (130) and a lower solder edge (132) upon installation of the glass funnel (100) in a television set.

The upper solder edge (130) is connected to the vertical solder edges (126, 128) to form an upper, right, solder edge corner (134) and an upper, left, solder edge corner (136) upon installation in a television set. The lower solder edge (132) is connected with the vertical solder edges (126, 128) to form a lower, right, solder edge corner (138) and a lower, left, solder edge corner (140).

The upper, right, solder edge corner (134) and the lower, left, solder edge corner (140) define a first diagonal plane (D1) being disposed substantially perpendicular to a faceplate (24 FIG. 12) and being disposed between the upper, right, solder edge corner (134) and the lower, left, solder edge corner (140). The upper, left, solder edge corner (136) and the lower, right, solder edge corner (138) define a second diagonal plane (D2) being disposed substantially perpendicular to the faceplate (24) and being disposed between the upper, left, solder edge corner (136) and the lower, right, solder edge corner (138).

The pair of vertical solder edges (126, 128) have respective midpoints (126*a*, 128*a*), which midpoints (126*a*, 128*a*) are being disposed substantially equidistant from the pair of horizontal solder edges (130, 132), and the midpoints (126*a*, 128*a*) defining a horizontal plane (A—A) being disposed substantially perpendicular to the faceplate (24). The pair of horizontal solder edges (130, 132) have respective midpoints (130*a*, 132*a*), which midpoints (130*a*, 132*a*) are disposed substantially equidistant from the pair of vertical solder edges (126, 128), and the midpoints (130*a*, 132*a*) define a vertical plane (B—B) which is disposed substantially perpendicular to the faceplate (24).

An intersection between the horizontal plane (A—A) and the pyramidal funnel body portion (32) defines a right horizontal straight linear portion (126*b*) on the right surface of the pyramidal funnel body portion (32), and a left horizontal straight linear portion (128*b*) on the left surface of the pyramidal funnel body portion (32).

An intersection between the vertical plane (B—B) and the pyramidal funnel body portion (32) defines an upper, vertical, straight linear portion (130*b*) on the upper surface of the pyramidal funnel body portion (32), and defines a lower, vertical, straight linear portion (132*b*) on the lower surface of the pyramidal funnel body portion (32).

A further intersection between the first diagonal plane (D1) and the pyramidal funnel body portion (32) defines a diagonal, right, upper straight linear portion (134*b*) on the upper surface of the pyramidal funnel body portion (32), and defines a diagonal, left, lower straight linear portion (140*b*) on the lower surface of the pyramidal funnel body portion (32). Similarly, an intersection between the second diagonal plane (D2) and the pyramidal funnel body portion (32) defines a diagonal, left, upper straight linear portion (136*b*) on the upper surface of the pyramidal funnel body portion (32), and defines a diagonal, right, lower straight linear portion (138*b*) on the lower surface of the pyramidal funnel body portion (32).

The straight linear portions (126*b*, 128*b*, 130*b*, 132*b*, 134*b*, 136*b*, 138*b*, 140*b*) extend substantially from the funnel throat transition portion (104) to the solder edge transition portion (106), but have been shown as straight lines in FIG. 5 for ease of understanding.

Figure 6:
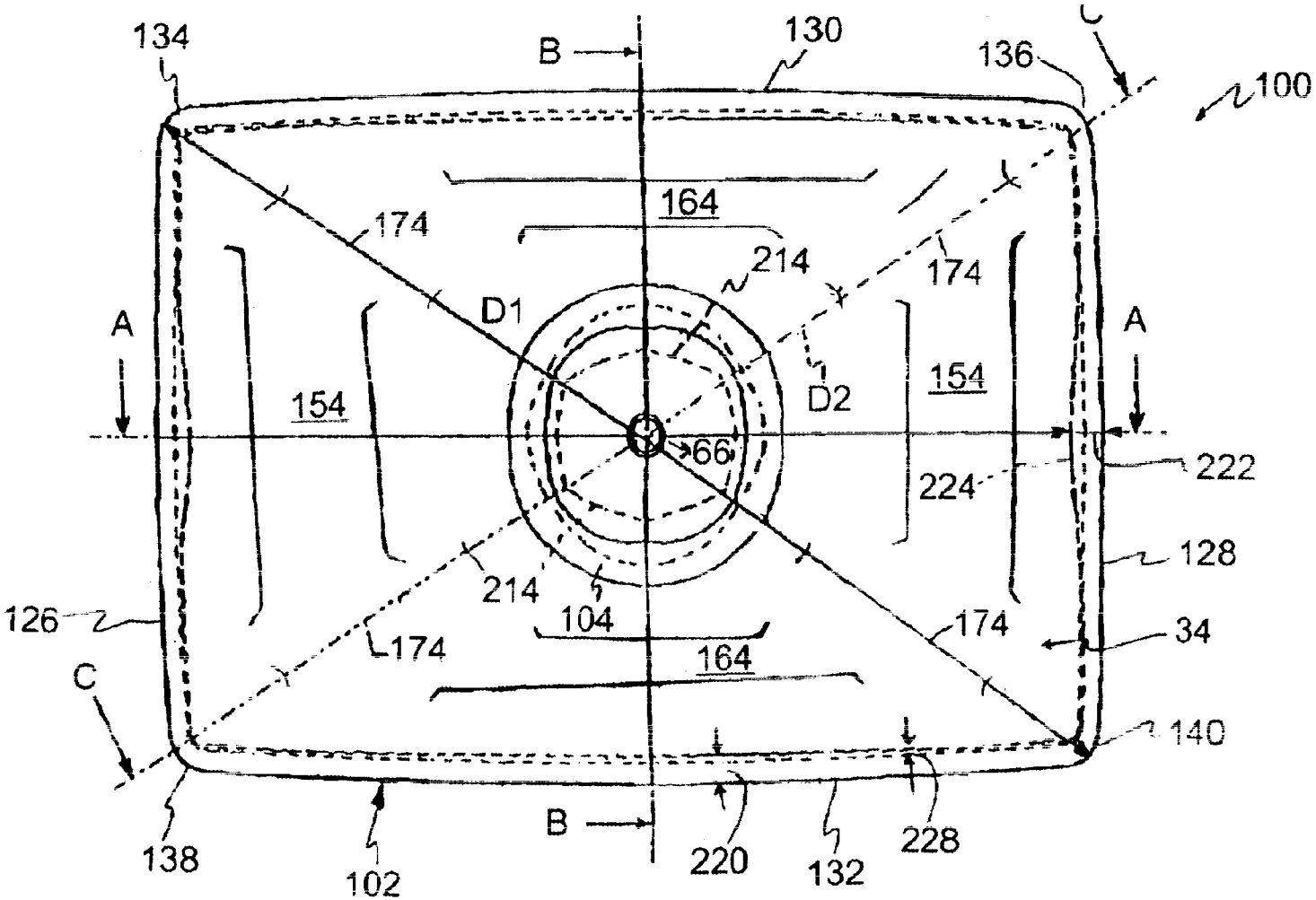
FIG. 6 is a view similar to FIG. 1 showing additional detail.

Thus, with reference to FIG. 6, illustrating a rearview of a glass funnel (10), in accordance with one embodiment of the invention, each horizontal portion (126*b*, 128*b*, A—A) has a sloped portion (154, compare FIG. 4) and the vertical portions (130*b*, 132*b*, B—B) have a sloped portion (164). Corresponding sloped portions (174) are indicated for the diagonals (D1) and (D2). The left solder edge (128) has a reinforced portion (224) having a predetermined thickness (222). The solder edge portion (102) has a wall thickness (220) and the web portion has a thickness (228). FIG. 6 illustrates possible straight sides (214) in the funnel throat transition portion (104).

More particularly, the funnel throat transition portion (104) has a portion having a cross-sectional configuration defined by substantially straight portions (214) to connect the cylindrical funnel throat (66) to a rectangular solder edge structure (102).

It will be appreciated that the glass funnel (10) is symmetric with respect to axis A—A and to axis B—B.

Figure 1:
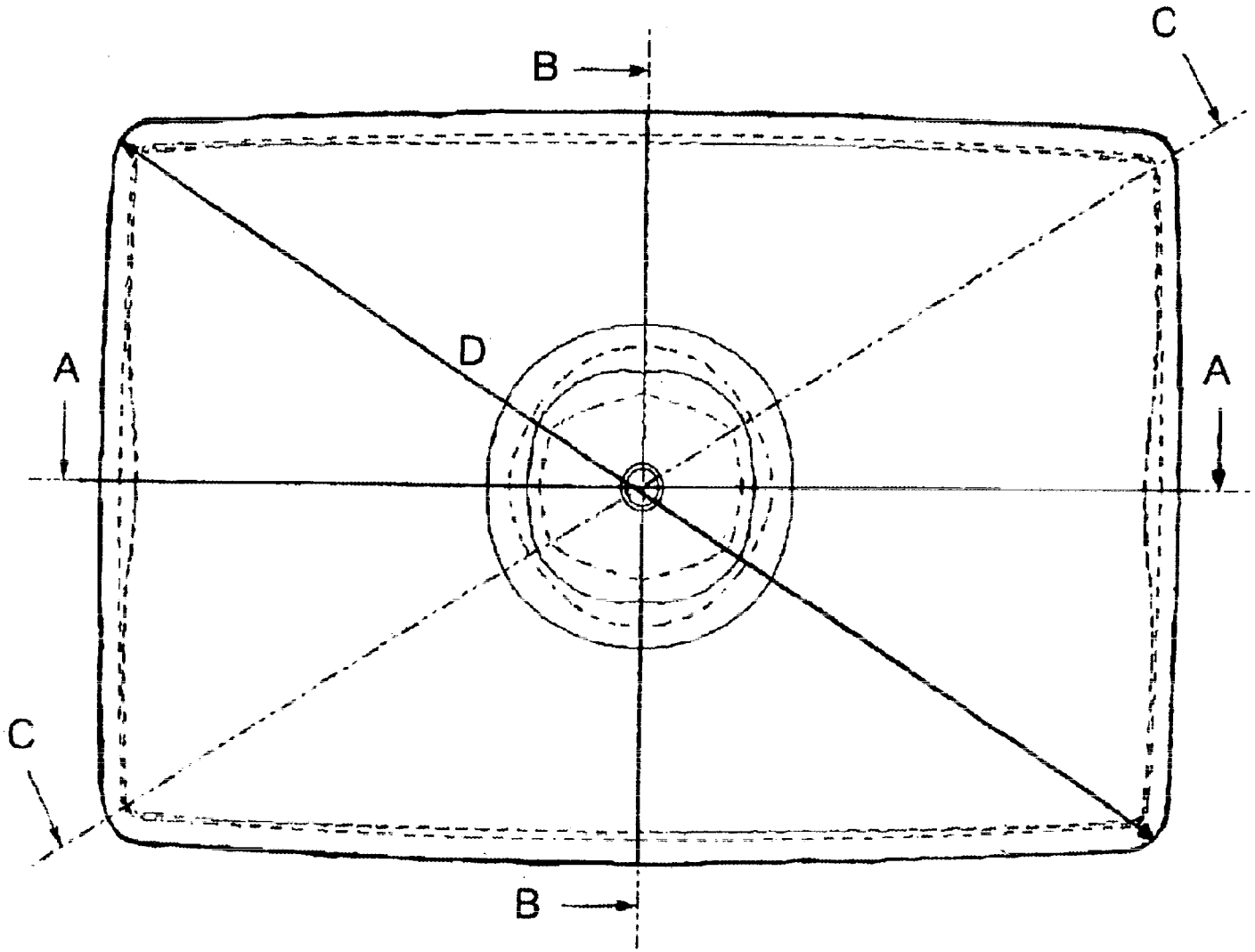
FIG. 1 shows a television glass funnel in an overhead view with the respective sections A—A, B—B and C—C, as well as the length D of the funnel diagonals.
Figure 7:
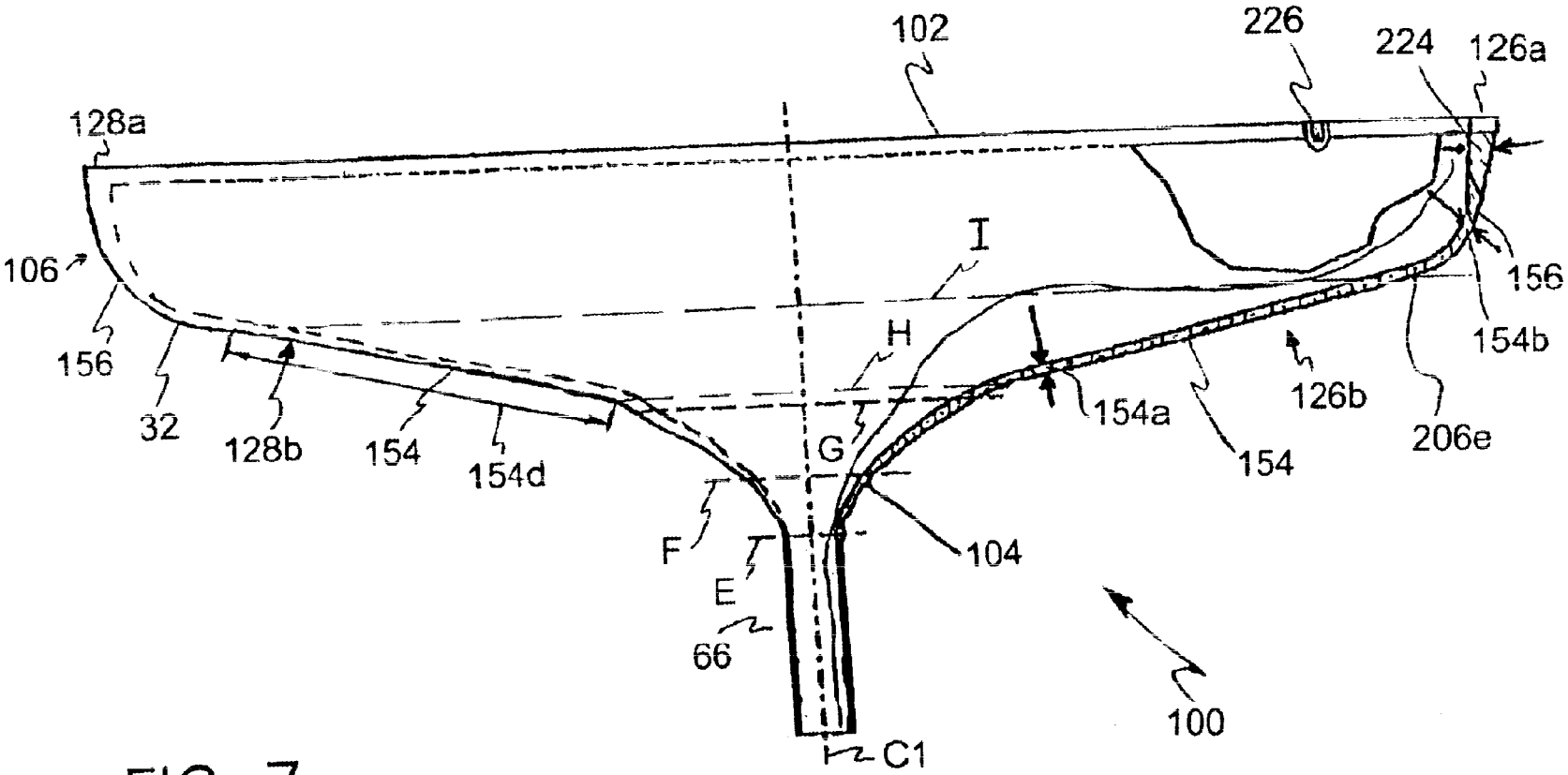
FIG. 7 is a cross-section along line A—A in FIG. 1.

FIG. 7 is a detailed cross-section along line A—A in FIG. 1, that is, from the right midpoint (126*a*) to the left midpoint (128*a*). Thus, there is illustrated the right linear portion (126*b*), as well as the left linear portion (128*b*), and the first transition portion (104) between the cylindrical funnel throat (66) and the funnel body (32). The two linear portions (126*b*, 128*b*) are joined to the second transition portion (106) by a curved portion (156). The second transition portion (106) terminates in the solder edge (102). The length of the slope (154) is designated by (154*d*). The wall thicknesses of interest are identified by (154*a*) and (154*b*). An interface (E) represents the transition from the cylindrical funnel throat portion (66) to the first transition portion (104). The interfaces (G) and (H) generally indicate the transition from the second transition portion (104) to the funnel body (32) and an interface (I) indicates the plane at which the slope (154) terminates on the outer surface (34) of funnel body (32). An interface (F) illustrates an internal transition of the first transition portion (104). Reference numeral (226) identifies an attachment portion for components of a cathode ray tube such as (20, FIG. 12). It will be appreciated that the section is symmetric about a center line (C1).

Figure 8:
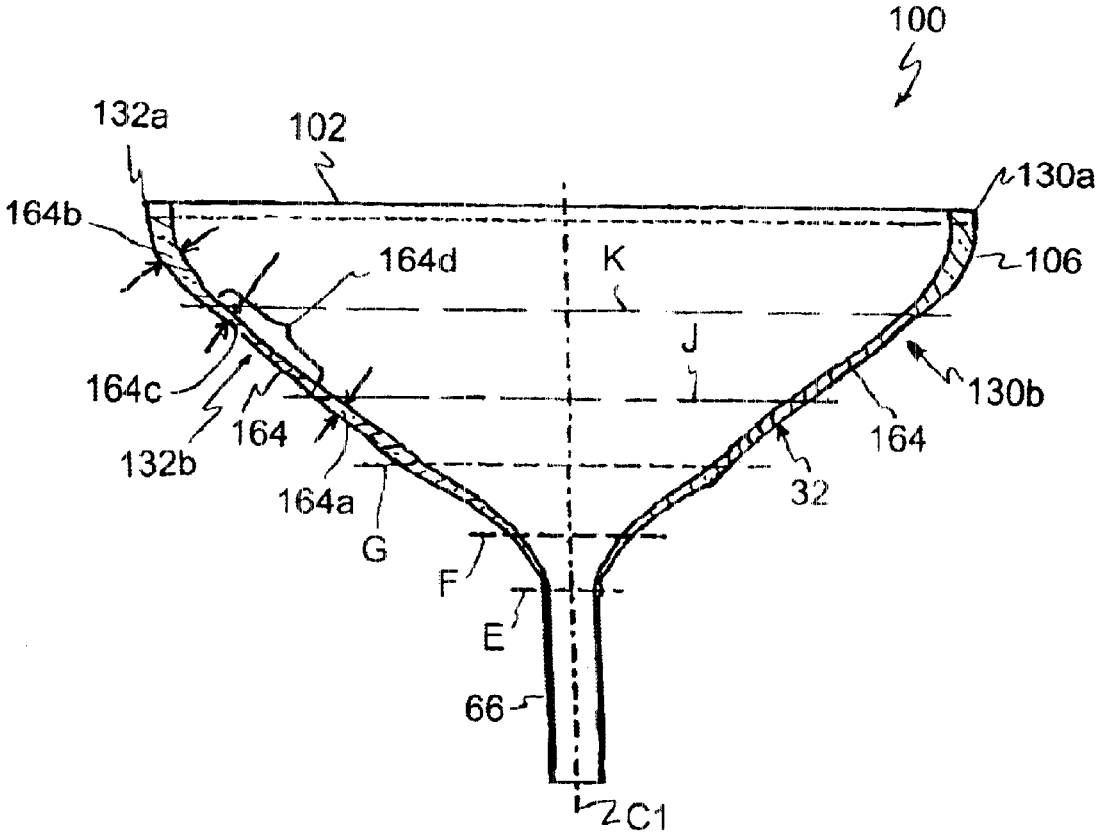
FIG. 8 is a cross-section along line B—B in FIG. 1.

FIG. 8 is a detailed cross-section along line B—B in FIG. 1, that is, from the top midpoint (130*a*) to the bottom midpoint (132*a*). Thus, there is illustrated the top linear portion (130*b*), as well as the bottom linear portion (132*b*), and the first transition portion (104) between the cylindrical funnel throat (66) and the funnel body (32). The two linear portions (130*b*, 132*b*) are joined to the solder edge (102) by the curved transition portion (106). The length of the slope (164) is designated by (164*d*). The wall thicknesses of interest are identified by (164*a*), (164*b*), and (164*c*). An interface (E) represents the transition from the cylindrical funnel throat Portion (66) to the first transition portion (104). An interface (G) generally indicates the transition from the second transition portion (104) to the funnel body (32) and an interface (J) indicates the plane at which the slope (164)

commences on the outer surface (34) of funnel body (32). The interface (F) illustrates an internal transition of the first transition portion (104). An interface (K) illustrates the plane at which the slope (164) terminates on the outer surface (34) of funnel body (32). Reference numeral (226) identifies an attachment portion for components of a cathode ray tube such as (20, FIG. 12). It will be appreciated that the section is symmetric about the center line (C1).

Figure 9:
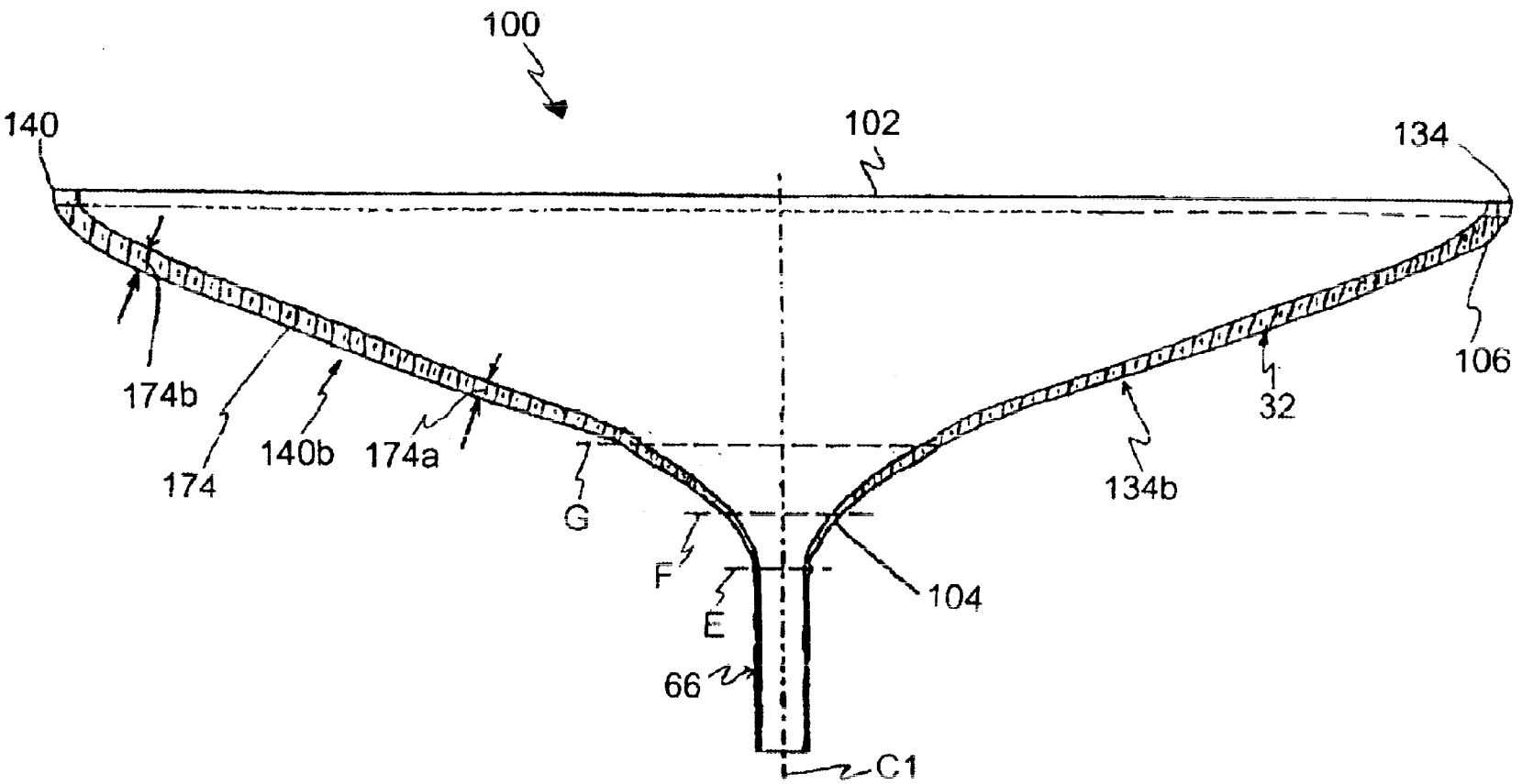
FIG. 9 is a cross-section along line C—C in FIG. 1.

FIG. 9 is a detailed cross-section along line C—C in FIG. 1, that is, from the corner (134) to the corner (140). Thus, there is illustrated the top right linear portion (134*b*), as well as the bottom left linear portion (140*b*), and the first transition portion (104) between the cylindrical funnel throat (66) and the funnel body (32). The two linear portions (134*b*, 140*b*) are joined to the solder edge (102) by the curved transition portion (106). In one embodiment, the slope (174) extends substantially from the interface (G) to the solder edge (102). The wall thicknesses of interest are identified by (174*a*) and (174*b*). The interface (E) represents the transition from the cylindrical funnel throat portion (66) to the first transition portion (104). Interface (G) generally indicates the transition from the second transition portion (104) to the funnel body (32). It will be appreciated that the section is symmetric about the center line (C1).

It will further be appreciated that the steepness of the horizontal slope (154) is shallower than either the steepness of the vertical slope (164) or the steepness of the diagonal slope (174). As well, the steepness of the diagonal slope (174) is shallower than the steepness of the vertical slope (164).

Figure 10:
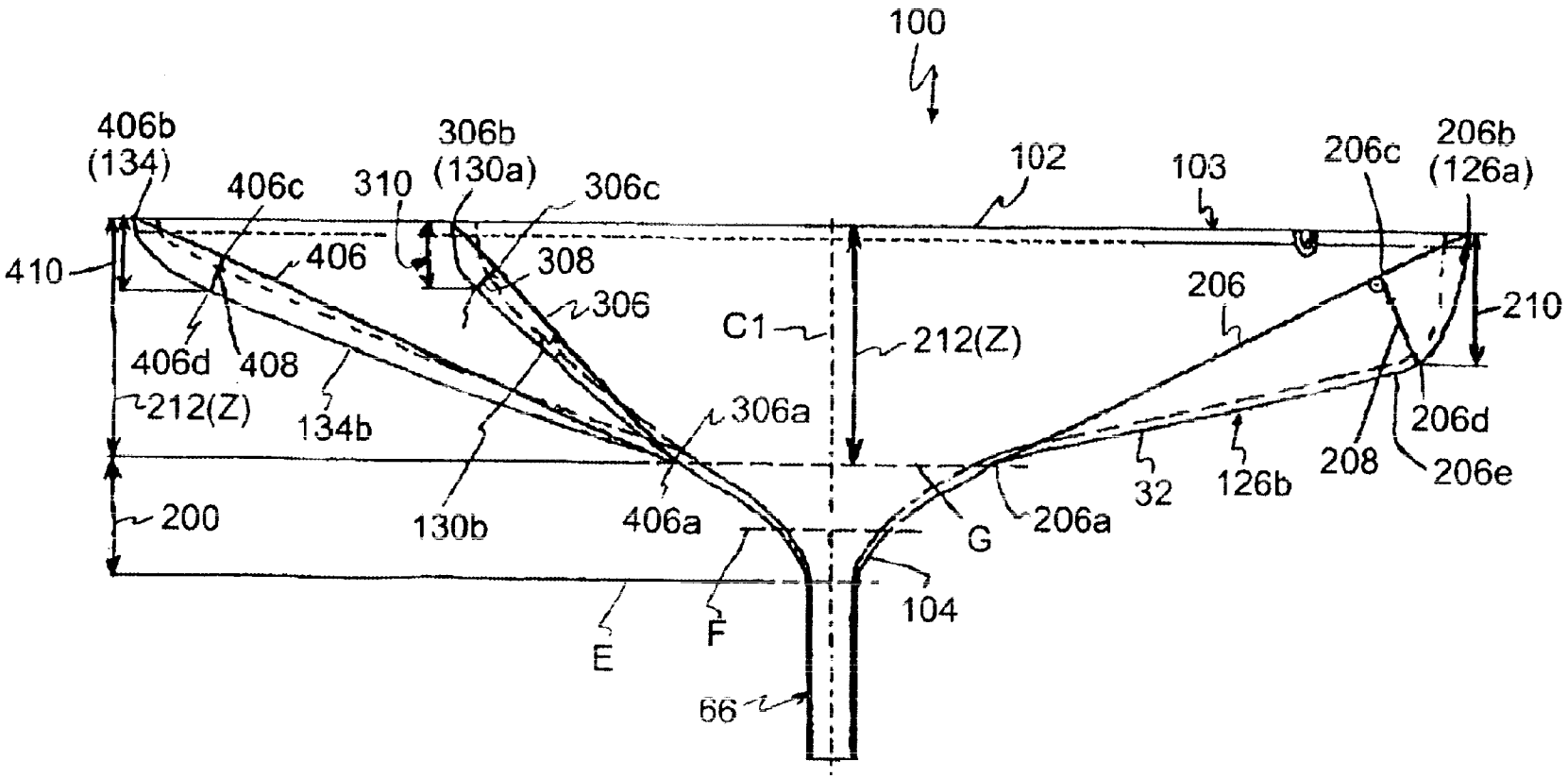
FIG. 10 is a schematic view similar to FIG. 3 showing additional detail.

Thus, the first, horizontal, height (210, FIG. 10) from the solder edge portion (102), is sufficiently great to dispose and configure each of the horizontal straight linear portions (126*b*, 128*b*) to have the shallowest slope (154) of all of the straight linear portions (126*b*, 128*b*, 130*b*, 132*b*, 134*b*, 136*b*, 138*b*, 140*b*).

In one embodiment of the invention the first substantially straight linear portion (154) has a first wall thickness (154*a*) and the third substantially straight linear portion (174) has a first wall thickness (174*a*) adjacent to the funnel throat transition portion (104) and has a second wall thickness (174*b*) adjacent to the solder edge transition portion (106), where the first wall thickness (154*a*) of the first substantially straight linear portion (154) is less than either the first wall thickness (174*a*) of the third substantially straight linear portion (174) or the second wall thickness (174*b*) of the third substantially straight linear portion (174).

As well, in accordance with one embodiment of the invention, the second substantially straight linear portion (164) can have a first wall thickness (164*a*) adjacent to the funnel throat transition portion (104) which is greater than the first wall thickness (154*a*) of the first substantially straight linear portion (154), where the second substantially straight linear portion (164) has a second wall thickness (164*b*) adjacent to the solder edge transition portion (106) which is greater than the first wall thickness (154*a*) of the first substantially straight linear portions (154); and the second substantially straight linear portion (164) has a third wall thickness (164*c*), being disposed between the first and wall thickness (164*a*) of the second substantially straight linear portion (164) and the second wall thickness (164*b*) of the second substantially straight linear portion (164); where the third wall thickness (164*c*) of the second substantially straight linear portion (164) is less than either the first wall thickness (164*a*) of the second substantially straight linear portion (164) or the second wall thickness (164*b*) of the second substantially straight linear portion (164).

As mentioned, the funnel body (32) and the funnel throat transition portion (104) are joined at an interface (G). Thus, with reference to FIG. 10, a distance from the solder edge plane (103) to the interface (G) along the central axis (56, C1) comprises a funnel body height (212, Z). The first region (126*b*) and the interface (G) intersect at a first interface point (206*a*) which first interface point (206*a*) and the first solder edge midpoint (126*a*) define a first straight line (206), between (206*a*) and (206*b*).

The first straight line (206) and the first region (126*b*) define a first maximum distance (208, 6.5, $H_{gr}$) therebetween.

In turn, the first maximum distance (208, 6.5, $H_{gr}$) defines a first maximum distance point (206*d*) on the outer surface (34) of the funnel body (32). The first maximum distance point (206*d*) is disposed at a first solder edge height (210, $Z_G$) from the solder edge plane (103) to the portion of the first substantially straight linear portion (154) being closest to the solder edge plane (103). In one embodiment of the invention, the ratio of the funnel body height (212, Z) and the first solder edge height (210, $Z_G$) is greater than the value 1.6.

Similarly, the second region (130*b*) and the interface (G) intersect at a second interface point (306*a*), which second interface point (306*a*) and the second solder edge midpoint (130*a*) define a second straight line (306) therebetween.

The second straight line (306) and the second region (130*b*) define a second maximum distance (308, 6.6, $H_{k1}$) therebetween, which, in turn, defines a second maximum distance point (306*d*) on the outer surface (34) of the funnel body (32).

The second maximum distance point (306*d*) is disposed at a second solder edge height (310, $Z_K$) from the solder edge plane (103). In one embodiment of the invention, the ratio of the funnel body height (212, Z) and the second solder edge height (310, $Z_K$) is greater than the value 2.6.

With respect to a diagonal portion, the third region (134*b*) and the interface (G) intersect at a third interface point (406*a*), with the third interface point (406*a*) and the corner (134, 406*b*) defining a third straight line (406) therebetween.

The third straight line (406) and the third region (134*b*) define a third maximum distance (408, 6.4, $H_{dia}$) therebetween, which third maximum distance (408, 6.4, $H_{dia}$) defines a third maximum distance point (406*d*) on the outer surface (34) of the funnel body (32). The third maximum distance point (406*d*) is disposed at a third solder edge height (410, $Z_D$) from the solder edge plane (103). In one embodiment, the ratio of the funnel body height (212, Z) and the solder edge height (410, $Z_D$) is greater than the value 2.5.

In one embodiment, the solder edge plane (103) has a straight diagonal length (D, FIG. 1), thus the ratio of the straight diagonal length (D) and the first maximum distance (208, 6.5, $H_{gr}$) may be less than the value 25.

In one embodiment, the ratio of the straight diagonal length (D) and the second maximum distance (308, 6.6, Hk1) may be greater than the value 33.

In one embodiment, the ratio of the straight diagonal length (D) and the third maximum distance (408, 6.4, $H_{dia}$) may be greater than the value 28.

It will be appreciated that a point such as (206*e*) is disposed from the solder edge plane (103) to that portion of the first substantially straight linear portion (126*b*) that is closest to the solder edge plane (103).

In one embodiment, the points (206*d*) and (206*e*) may be congruent dependent upon the structure.

Figure 11:
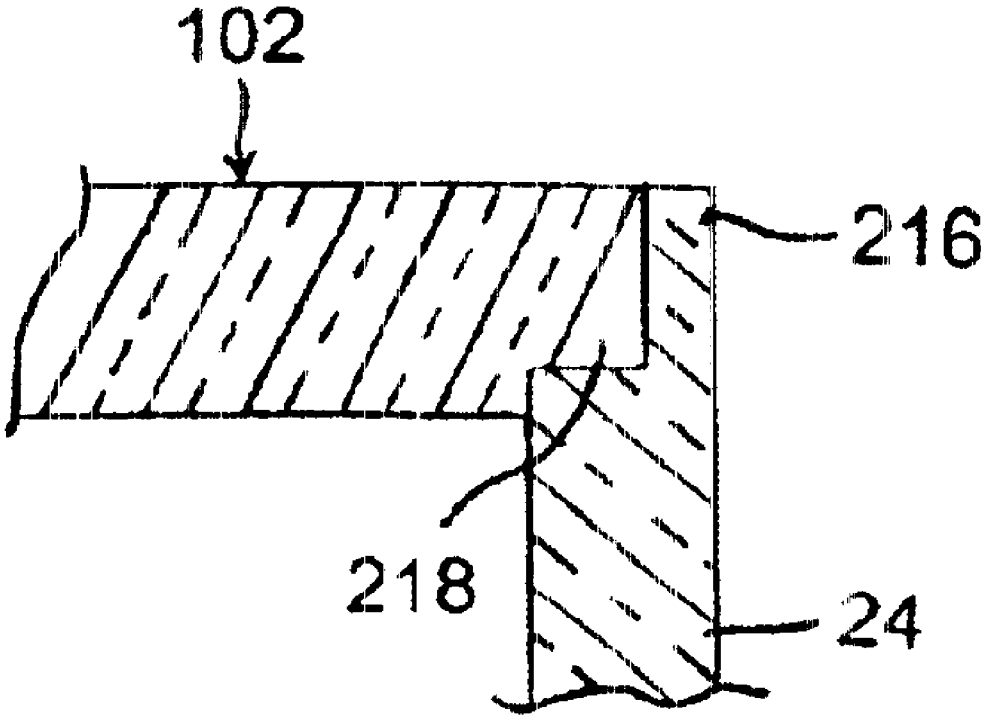
FIG. 11 is a detail showing a part of the joint between a faceplate and a glass funnel

In one embodiment, see FIG. 11, the faceplate (24) has a recessed peripheral portion (216), and the solder edge (102)

has an elongate peripheral portion (218) to interlock with the recessed peripheral portion (216) of the faceplate (24); and the glass funnel (10, 100) is soldered to the faceplate (24).

Figure 12:
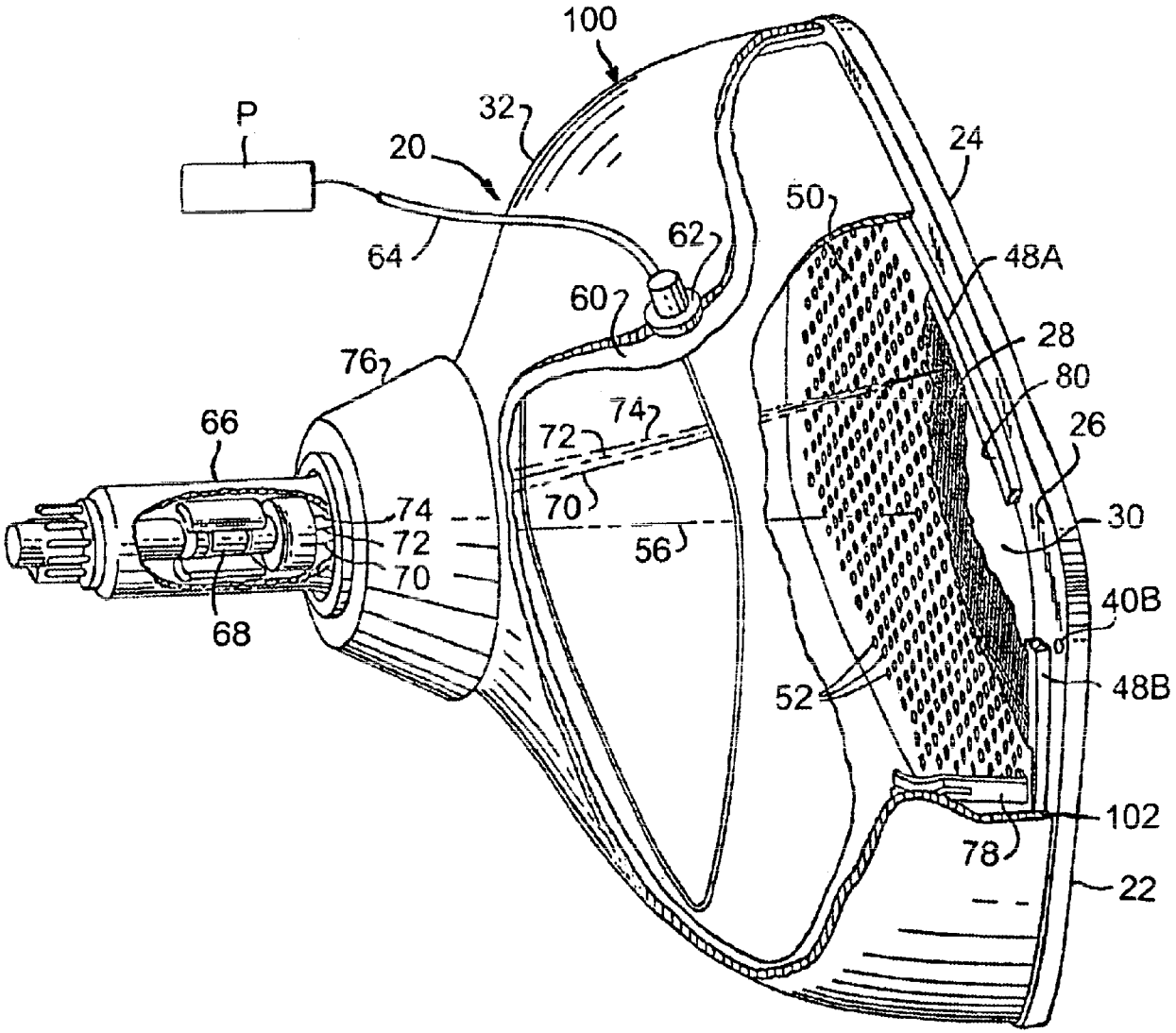
FIG. 12 is a perspective view from the rear of a cathode ray tube according to one embodiment of the invention.

FIG. 12 is a perspective view from the rear of a cathode ray tube according to one embodiment of the invention. Referring to FIG. 12, there is shown a partially cutaway perspective view of a color cathode ray tube (CRT) (20). The color cathode ray tube (20) includes a flat faceplate (24) positioned upon and securely mounted to the forward edge portion such as (102) of a funnel or funnel body (32). The flat faceplate (24) and the funnel body (32) may be made of glass, with the enclosed structure thus formed evacuated by conventional means (not shown) after various electronic components are positioned therein and the structure is then sealed. Positioned within the throat of neck portion (66) of the funnel (32) is an in-line electron gun means (68) which is aligned with the anterior-posterior axis of the CRT, which axis is identified by (56, C1). The in-line electron gun or electron gun means (68) is configured to emit a plurality of electron beams (70, 72 and 74) which are directed through apertures (52) in a metal foil shadow mask (50) which is maintained under high tension and is closely spaced relative to the inner surface (26) of the faceplate (24). A magnetic deflection yoke (76) is positioned about neck or throat (66) of funnel body (32). Horizontal and vertical deflection currents may be provided to the magnetic deflection yoke (76) for deflecting the three electron beams in a timed manner across the faceplate (24).

A high voltage electron accelerating potential is applied from a power supply (P) via a conductor (64) to an anode button (62) on the funnel body (32). The anode button (62) extends through the wall of the funnel body (32) and is in electrical contact with an internal conductive coating (60) on the inner surface of the funnel (32). A contact spring (78) is electrically coupled to the internal conductive coating (60) and is further coupled to the metal foil shadow mask (50) such as by means of a weldment. Electrical contact is also established between the metal foil shadow mask (50) and a metal cap (80) on each of rails (48A, 48B) which are used for mounting and positioning the metal foil shadow mask (50) within the cathode ray tube (20). Disposed on the inner surface of the glass faceplate (24) is a film of reflective and electrically conductive aluminum (30). Mounted to the faceplate (24) and positioned between the reflective and conductive aluminum film (30) and the flat tension shadow mask (50) is a phosphor screen (28) responsive to electrons incident thereon for emitting light when excited by electrons emitted by the electron gun means (68).

FIG. 12 is a copy of FIG. 1 from U.S. Pat. No. 4,788,471, issued to Strauss on Nov. 29, 1988 and entitled, "Sealing for CRT components," from which figure copy some of the reference numerals present in the original figure, as it appears in U.S. Pat. No. 4,788,471 have been removed. U.S. Pat. No. 4,788,471 is hereby incorporated by reference as if set forth in its entirety. The reference numerals that have been removed from the figure for this U.S. patent, essentially reproduced herein as FIG. 12, indicate arrangements that are well known in the prior art.

It will be appreciated that the solder edge transition portion (106), in one possible embodiment, may be substantially flat, or without a predominant rounding as described with reference to curved transition portion (106).

In one embodiment, the faceplate (24) may have a recess or chamfer and the solder edge portion or structure (102 has a matching elongation being soldered to the faceplate (24). In one embodiment, the faceplate (24) may possibly have an elongation and the solder edge portion or structure (104) may have a matching depression or recess.

In one embodiment this invention relates to a television glass funnel for a television cathode ray tube for soldering to a screen. The television glass funnel with a solder edge, a funnel throat, a parabolic area and a funnel body is characterized by the fact that the external contour between the solder edge and the parabolic area along a section C—C which is defined by the direction of the diagonal of the television glass funnel is essentially a steeply descending straight line, along a section A—A, which is defined by the direction of the major axis of the television glass funnel, is essentially a flat descending straight line, which descends steeply in a curve in the area of the solder edge, and along the section B—B which is defined by the direction of the small axis of the television glass funnel, is essentially a steeply descending straight line.

One feature of the invention resides broadly in a television glass funnel (10) for a television cathode ray tube with a solder edge (7), a funnel throat (1), a parabolic area (2), and a funnel body (8), characterized by the fact that the external contour between the solder edge (7) and the parabolic area (2) along a section C—C which is defined by the direction of the diagonal (3.1) of the television glass funnel (10), is essentially a steeply descending straight line, along a section A—A, which is defined by the direction of the major axis (3.2) of the television glass funnel (10), is essentially a flat, or relatively flat, or more gently sloped, descending straight line, which descends sharply in a curve shape in the area of the solder edge (7), and along the section B—B which is defined by the direction of the minor axis (3.3) of the television glass funnel (10), is essentially a steeply descending straight line.

Another feature of the invention resides broadly in a television glass funnel characterized by the fact that the steepness, or inclination, of the respective straight lines is: Steepness of minor axis (3.3)>>steepness of the diagonal (3.1)>steepness of the major axis (3.2).

Yet another feature of the invention resides broadly in a television glass funnel, characterized by the fact that along the diagonals (3.1), the wall thicknesses (4.1, 4.2) are essentially greater than the wall thicknesses (4.3) in the area (3.5) along the major axis (3.2).

Still another feature of the invention resides broadly in a television glass funnel characterized by the fact that along the minor axis (3.3), the wall thicknesses (4.5, 4.6) are essentially greater than along the major axis (3.2), whereby the wall thickness (4.7) in the area (3.4) between approximately ¼ of the height to ½ of the height above the solder edge (11) is less than the wall thicknesses (4.5, 4.6).

A further feature of the invention resides broadly in a television glass funnel characterized by the fact that the curvature of the external contour is as follows: for the diagonal $Z/Z_D>2.5$, for the major axis $Z/Z_G>1.6$, and for the minor axis $Z/Z_K>2.6$.

Another feature of the invention resides broadly in a television glass funnel characterized by the fact that the ratio between the respective maximum distance H (6.4, 6.5, 6.6) from the respective external contour (3.1, 3.2, 3.3) and the respective direct straight line connecting the outer edge of the solder edge (6.3) and the outer transition (6.2) from the funnel body (8) to the parabolic area (2) and the diagonal dimension (D) is as follows: in the direction of the diagonal (3.1) $D/H_{dia}>28$, in the direction of the major axis (3.2) $D/H_{gr}<25$, and in the direction of the minor axis (3.3) $D/H_{k1}>33$.

Yet another feature of the invention resides broadly in a television glass funnel characterized by the fact that the parabolic area (2), in at least one partial segment between the connecting points to the funnel throat (1) and to the funnel body (8) has a rectangular cross section.

Still another feature of the invention resides broadly in a television glass funnel characterized by the fact that the television glass funnel (10) is soldered with a screen, whereby the screen has an abbreviated web and the height of the television glass funnel (10) is elongated correspondingly.

In other words, another feature of the invention resides broadly in a television glass funnel characterized by the fact that the steepness, or inclination, of the respective straight lines is: Steepness of minor axis (3.3) much greater than steepness of the diagonal (3.1) and steepness of the diagonal is greater than the steepness of the major axis (3.2).e diagonals (3.1), the wall thicknesses (4.1, 4.2) are essentially greater than the wall thicknesses (4.3) in the area (3.5) along the major axis (3.2).

In other words, a further feature of the invention resides broadly in a television glass funnel characterized by the fact that the curvature of the external contour is as follows: for the diagonal: Z to $Z_D$ is greater than 2.5, for the major axis: Z to $Z_G$ is greater than 1.6, and for the minor axis: Z to $Z_K$ is greater than 2.6.

In other words, another feature of the invention resides broadly in a television glass funnel characterized by the fact that the ratio between the respective maximum distance H (6.4, 6.5, 6.6) from the respective external contour (3.1, 3.2, 3.3) and the respective direct straight line connecting the outer edge of the solder edge (6.3) and the outer transition (6.2) from the funnel body (8) to the parabolic area (2) and the diagonal dimension (D) is as follows: in the direction of the diagonal (3.1) D to $H_{dia}$ is greater than 28, in the direction of the major axis (3.2) D to $H_{gr}$ is greater than 25, and in the direction of the minor axis (3.3) D to $H_{k1}$ is greater than 33.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Application of Germany Patent Application No. 100 63 034.0, filed on Dec. 18, 2000, entitled, "FERNSEHGLASTRICHTER," having inventors Stefan HERGOTT, Michael VOGEL, Volker KNOCHE, Dr. Ralf KEHLENBECK, and Oliver M ÜHLKE, and DE-OS 100 63 034, having inventors Stefan HERGOTT, Michael VOGEL, Volker KNOCHE, Dr. Ralf KEHLENBECK, and Oliver MÜHLKE, and DE-PS 100 63 034 having inventors Stefan HERGOTT, Michael VOGEL, Volker KNOCHE, Dr. Ralf KEHLENBECK, and Oliver M ÜHLKE, as well as their published equivalents, and other equivalents or corresponding applications, if any, in corresponding cases in the Federal republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

All of the references and documents, cited in any of the documents cited herein, and the references they are in turn cited in are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

The details in the patents, patent applications and publications may be considered to be incorporable, at applicant's option, into the claims during prosecution as further limitations in the claims to patentably distinguish any amended claims from any applied prior art.

Some examples of cathode ray tubes and glass funnels and their arrangement in cathode ray tubes, such as, for television tubes, as well as related methods, features of which may possibly be used or adapted for use in at least one possible embodiment of the invention may be found in the following U.S. Pat. No. 3,988,136, issued to Rogers on Oct. 26, 1976 and entitled, "Method for reducing thermally induced fracture of cathode ray tube bulbs during salvage"; U.S. Pat. No. 3,997,811, issued to Tom, et al. on Dec. 14, 1976 and entitled, "Color television tube structure and method of manufacture"; U.S. Pat. No. 4,002,941, issued to Demmy on Jan. 11, 1977 and entitled, "Shadow mask cathode ray tube shield"; U.S. Pat. No. 4,033,687, issued to Hirayama, et al. on Jul. 5, 1977 and entitled, "Cathode ray tube pickup device"; U.S. Pat. No. 4,050,602, issued to Tom, et al. on Sep. 27, 1977 and entitled, "Color television tube structure and method of manufacture"; U.S. Pat. No. 4,158,419, issued to Nolan on Jun. 19, 1979 and entitled, "Implosion protected CRT"; U.S. Pat. No. 4,168,010, issued to Dougherty on Sep. 18, 1979 and entitled, "Implosion protected color cathode ray tube bulb and bulb components"; U.S. Pat. No. 4,176,891, issued to Antonucci, et al. on Dec. 4, 1979 and entitled, "Salvage method for cathode ray tubes"; U.S. Pat. No. 4,442,376, issued to Van der Waal, et al. on Apr. 10, 1984 and entitled, "Color display tube having heavy metal coating on color selection electrode"; U.S. Pat. No. 4,467,241, issued to Hines on Aug. 21, 1984 and entitled, "CRT with magnetic shield"; U.S. Pat. No. 4,520,115, issued to Speit, et al. on May 28, 1985 and entitled, "High absorbance Pb-containing glass for cathode ray tube picture screen"; U.S. Pat. No. 4,788,471, issued to Strauss on Nov. 29, 1988 and entitled, "Sealing for CRT components"; U.S. Pat. No. 4,806,819, issued to Nill on Feb. 21, 1989 and entitled, "Shadow mask mounting apparatus in color picture tube"; U.S. Pat. No. 4,826,463, issued to Strauss on May 2, 1989 and entitled, "Sealing for CRT components"; U.S. Pat. No. 4,961,023, issued to Vrijssen, et al. on Oct. 2, 1990 and entitled, "Cathode ray tube including a helical focusing lens"; U.S. Pat. No. 5,025,490, issued to Tamura, et al. on Jun. 18, 1991 and entitled, "Cathode-ray tube with its display front protected from undesirable electrification"; U.S. Pat. No. 5,138,461, issued to Kawamura, et al. on Aug. 11, 1992 and entitled, "Implosion-protected cathode-ray tube"; U.S. Pat. No. 5,357,166, issued to Sugahara, et al. on Oct. 18, 1994 and entitled, "Cathode-ray tube having alternating electric field reduction device"; U.S. Pat. No. 5,383,948, issued to Muir on Jan. 24, 1995 and entitled, "Method and apparatus for crackoff and neck sealing of cathode ray tube funnels"; U.S. Pat. No. 5,506,466, issued to Shoda, et al. on Apr. 9, 1996 and entitled, "Color cathode-ray tube"; U.S. Pat. No. 5,534,096, issued to Saito, et al. on Jul. 9, 1996 and entitled, "Cathode-ray tube apparatus and method of producing the same"; U.S. Pat. No. 5,751,103, issued to Opresko, et al. on Mar. 12, 1998 and entitled, "Color picture tube having improved funnel"; U.S. Pat. No. 5,785,727, issued to Mine, et al. on Jul. 28, 1998 and entitled, "Glass forming machine"; U.S. Pat. No. 5,804,912, issued to Park on Sep. 8, 1998 and entitled, "Magnetic shielding CRT"; U.S. Pat. No. 5,818,156, issued to Misono on Oct. 6, 1998 and entitled, "Color cathode-ray tube"; U.S. Pat. No. 5,938,806, issued to Mine, et al. on Aug. 17, 1999 and entitled, "Glass forming machine and glass forming method"; U.S. Pat. No. 5,973,448, issued to Segner, et al. on Oct. 26, 1999 and entitled, "Display screen for a cathode ray tube of glass having an adjustable spectral transmission curve and a method for producing the same"; U.S. Pat. No. 5,982,087, issued to Honda, et al. on Nov. 19, 1999 and entitled, "Deflection yoke and color cathode ray tube comprising the deflection yoke"; U.S. Pat. No. 5,986,397, issued to Honda, et al. on Nov. 16, 1999 and entitled, "Deflection yoke and color cathode ray tube comprising the deflection yoke"; U.S. Pat. No. 6,002,203, issued to Yokata, et al. on Dec. 14, 1999 and entitled, "Cathode ray tube having an envelope shaped to reduce beam deflection power requirements"; U.S. Pat. No. 6,016,028, issued to Iguchi, et al. on Jan. 18, 2000 and entitled, "Glass bulb for color picture tube and the same tube"; U.S. Pat. No. 6,018,217, issued to Fondrik on Jan. 25, 2000 and entitled, "CRT funnel with compliant corners and CRT envelope incorporating same"; U.S. Pat. No. 6,046,534, issued to Horiuchi on Apr. 4, 2000 and entitled, "Color selecting electrode for color cathode-ray tube"; U.S. Pat. No. 6,066,914, issued to Shimizu, et al. on May 23, 2000 and entitled, "Color cathode ray tube"; U.S. Pat. No. 6,130,502, issued to Kobayashi, et al. on Oct. 10, 2000 and entitled, "Cathode assembly, electron gun assembly, electron tube, heater, and method of manufacturing cathode assembly and electron gun assembly"; U.S. Pat. No. 6,163,106, issued to Sugawara, et al. on Dec. 19, 2000 and entitled, "Color cathode ray tube and water resistant glass frit"; U.S. Pat. No. 6,183,344, issued to Tsuchimoto, et al. on Feb. 6, 2001 and entitled, "Method for grinding glass funnel seal edge and apparatus therefor"; U.S. Pat. No. 6,183,871, issued to Lee, et al. on Feb. 6, 2001 and entitled, "Sealing glass paste for cathode ray tubes"; U.S. Pat. No. 6,201,345, issued to Nakagawa, et al. on Mar. 13, 2001 and entitled, "Cathode-ray tube with electron beams of increased current density"; U.S. Pat. No. 6,208,067, issued to Nakagawa, et al. on Mar. 27, 2001 and entitled, "Color cathode ray tube"; U.S. Pat. No. 6,213,836, issued to Nagata, et al. on Apr. 10, 2001 and entitled, "Cathode ray tube and method for manufacturing the same"; U.S. Pat. No. 6,218,775, issued to Tammaro on Apr. 17, 2001 and entitled, "Cathode ray tube neck glass"; U.S. Pat. No. 6,252,341, issued to Hasegawa, et al. on Jun. 26, 2001 and entitled, "Impregnated cathode having varying surface porosity"; U.S. Pat. No. 6,259,216, issued to Eckhardt, et al. on Jul. 10, 2001 and entitled, "Cathode ray tube"; U.S. Pat. No. 6,274,974, issued to Ito, et al. on Aug. 14, 2001 and entitled, "Color cathode ray tube having an improved shadow mask structure"; U.S. Pat. No. 6,280,849, issued to Miwa on Aug. 28, 2001 and entitled, "Glass article having surface coating of boric acid and method for producing the same"; U.S. Pat. No. 6,287,651, issued to Sasaki, et al. on Sep. 11, 2001 and entitled, "Cathode ray tube glass, a method for producing the cathode ray tube glass, and a method for cleaning the cathode ray tube glass; and U.S. Pat. No. 6,294,863, issued to Shimizu, et al. on Sep. 25, 2001 and entitled, "Color cathode ray tube having a shadow mask with a plurality of strip shaped reinforcing beads". All of the foregoing patents are hereby incorporated by reference as if set forth in their entirety herein.

Some examples of glass material for cathode ray tubes for televisions, features of which may possible be used or adapted for use in an embodiment of the invention may be found in the following U.S. Pat. No. 4,174,490, issued to Van Erk, et al. on Nov. 13, 1979 and entitled, "Cathode-ray tube"; U.S. Pat. No. 4,277,286, issued to Boyd, et al. on Jul. 7, 1981 and entitled, "Lead-free glasses of high x-ray absorption for cathode ray tubes"; U.S. Pat. No. 4,366,252, issued to Weaver on Dec. 28, 1982 and entitled, "Fluorine-free, zirconia-free, X-ray absorbing silica based glass, containing oxides of lead, barium and strontium plus oxides of calcium, magnesium, sodium, potassium, cerium, titanium, arsenic and antimony"; U.S. Pat. No. 4,390,637, issued to Daiku on Jun. 28, 1983 and entitled, "X-ray absorbing glass for a color cathode ray tube having a controlled chromaticity value and a selective light absorption"; U.S. Pat. No. 4,520,115, issued to Speit, et al. on May 28, 1985 and entitled, "High absorbance Pb-containing glass for cathode ray tube picture tube"; U.S. Pat. No. 4,599,319, issued to Sack on Jul. 8, 1986 and entitled, "PbO-free glasses for cathode ray tubes having a high protective effect against X-rays while simultaneously having good resistance to acid and stability to radiation"; U.S. Pat. No. 4,607,189, issued to Born on Aug. 19, 1986 and entitled, "Cathode ray tube with glass-to-metal seal using silver chloride cement"; U.S. Pat. No. 5,061,874, issued to Hecq, et al. on Oct. 29, 1991 and entitled, "Glass article having low specular reflection;" U.S. Pat. No. 5,238,132, issued to Shibaoka, et al. on Aug. 24, 1993 and entitled, "Glass pressure-vessel for a cathode ray tube"; U.S. Pat. No. 5,336,287, issued to Akimoto, et al. on Aug. 9, 1994 and entitled, "Method for bonding glass and metal"; U.S. Pat. No. 5,391,523, issued to Marlor on Feb. 21, 1995 and entitled, "Electric lamp with lead free glass"; U.S. Pat. No. 5,468,692, issued to Boeck, et al. on Nov. 21, 1995 and entitled, "Non-browning cathode ray tube glasses"; U.S. Pat. No. 5,468,693, issued to Comte on Nov. 21, 1995 and entitled, "Lead-free glasses exhibiting characteristics of crystal"; U.S. Pat. No. 5,925,977, issued to Sugawara, et al. on Jul. 20, 1999 and entitled, "Strengthened glass bulb for a cathode ray tube"; U.S. Pat. No. 6,097,144, issued to Lehman on Aug. 1, 2000 and entitled "Cathode ray tubes having reduced glass browning properties"; U.S. Pat. No. 6,163,106, issued to Sugawara, et al. on Dec. 19, 2000 and entitled, "Color cathode ray tube and water resistant glass frit"; U.S. Pat. No. 6,218,775 issued to Tammaro on Apr. 17, 2001 and entitled, "Cathode ray tube neck glass"; U.S. Pat. No. 6,245,699, issued to Hudecek, et al. on Jun. 12, 2001 and entitled, "High strength sealing glass"; and U.S. Pat. No. 6,251,811, issued to Yanagisawa, et al. on Jun. 26, 2001 and entitled, "Funnel glass for a cathode ray tube." All of the foregoing patents are hereby incorporated by reference as if set forth in their entirety herein.

Some example of glass funnel configurations, features of which may possibly be used or adapted for use in at least one possible embodiment of the invention may be found in the following U.S. Pat. No. 2,969,162, issued to Stutske on Jan. 24, 1961 and entitled, "Molded picture tube"; U.S. Pat. No. 3,720,345, issued to Logue on Mar. 13, 1973 and entitled, "Television bulb with improved strength"; U.S. Pat. No. 5,751,103, issued to Opresko, et al. on May 12, 1998 and entitled, "Color picture tube having improved funnel"; U.S. Pat. No. 5,837,026, issued to Sugawara, et al. on Nov. 17, 1998 and entitled, "Method of producing a glass panel for a cathode ray tube"; U.S. Pat. No. 6,002,203, issued to Yokota, et al. on Dec. 14, 1999 and entitled, "Cathode ray tube having an envelope shaped to reduce beam deflection power requirements"; U.S. Pat. No. 6,188,173, issued to Kang, et al. on Feb. 13, 2001 and entitled, "Cathode ray tube"; U.S. Pat. No. 6,208,068, issued to Lee, et al. on Mar. 27, 2001 and entitled, "Cathode ray tube"; and U.S. Pat. No. 6,307,313, issued to Fukuda on Oct. 23, 2001 and entitled, "Cathode ray tube apparatus". All of the foregoing patents are hereby incorporated by reference as if set forth in their entirety herein.

Some examples of cathode ray tube glass soldering and sealing, features of which may possibly be used or adapted for use in at least one possible embodiment of the invention may be found in the following U.S. Pat. No. 3,943,438, issued to barber, et al. on Mar. 9, 1976 and entitled, "Apparatus for testing a hermetic seal in a glass cathode ray tube"; U.S. Pat. No. 4,014,601, issued to Pittman on Mar. 29, 1977 and entitled, "Tube socket and method of using same"; U.S. Pat. No. 4,018,374, issued to Le, et al. on Apr. 19, 1977 and entitled, "Method for forming a bond between sapphire and glass"; U.S. Pat. No. 4,099,977, issued to Francel, et al. on Jul. 11, 1978 and entitled, "Sealing glass vehicle and composition for making same"; U.S. Pat. No. 4,120,678, issued to Francel, et al. on Oct. 17, 1978 and entitled, "Sealing glass vehicle and composition and method for making same"; U.S. Pat. No. 4,137,341, issued to Adachi, et al. on Jan. 30, 1979 and entitled, "method for coating a loop of a seal edge of cathode ray tube with viscous material"; U.S. Pat. No. 4,336,492, issued to Torre, et al. on Jun. 22, 1982"; U.S. Pat. No. 4,342,943, issued to Weaver on Aug. 3, 1982 and entitled, "$P_2O_5$—$V_2O_5$—PbO glass which reduces arcing in funnel portion of CRT"; U.S. Pat. No. 4,576,113, issued to Kambara, et al. on Mar. 18, 1986 and entitled, "Apparatus for coating viscous material on a seal edge surface of a cathode ray tube"; U.S. Pat. No. 4,640,700, issued to Takei, et al. on Feb. 3, 1987 and entitled, "Method for attaching a stud pin to a cathode ray tube panel"; U.S. Pat. No. 4,788,471, issued to Strauss on Nov. 29, 1988 and entitled, "Sealing for CRT components"; U.S. Pat. No. 4,792,722, issued to Francis on Dec. 20, 1988 and entitled, "Cathode ray tube having a flat faceplate attached by a compliant pressure bonded seal"; U.S. Pat. No. 4,826,463, issued to Strauss on May 2, 1989 and entitled, "Sealing for CRT components"; U.S. Pat. No. 4,883,439, issued to Sakamoto, et al. on Nov. 28, 1989 and entitled, "Apparatus for fixturing a cathode ray tube"; U.S. Pat. No. 4,891,544, issued to Capek, et al. on Jan. 2, 1990 and entitled, "Front assembly for a tension mask color cathode ray tube having a pre-sized mask"; U.S. Pat. No. 4,891,54, issued to Capek, et al. on Jan. 2, 1990 and entitled, "Faceplate front assembly with improved tension mask support structure"; U.S. Pat. No. 4,952,188, issued to Greiner, et al. on Aug. 28, 1990 and entitled, "Method for making mask support structure for a tension mask color cathode ray tube"; U.S. Pat. No. 5,277,640, issued to Shimmyou, et al. on Jan. 11, 1994 and entitled, "Frit seal furnace and mount for cathode-ray tube"; U.S. Pat. No. 5,514,629, issued to Morena on May 7, 1996 and entitled, "Fusion sealing materials and use in CRT"; U.S. Pat. No. 5,534,469, issued to Hayashi on Jul. 9, 1996 and entitled, "Low temperature non-crystallizing sealing glass"; U.S. Pat. No. 5,681,198, issued to Peng, et al. on Oct. 28, 1997 and entitled, "Vacuum seal method for cathode ray tubes"; and U.S. Pat. No. 6,139,388, issued to Mok, et al. on Oct. 31, 2000 and entitled, "Method of forming a frit seal between a stem and a neck of a cathode ray tube during manufacturing of a cathode ray tube". All of the foregoing patents are hereby incorporated by reference as if set forth in their entirety herein.

Some examples of 16:9 aspect ratio cathode ray tube displays, features of which may possibly be used or adapted for use in at least one possible embodiment of the present invention may be found in the following U.S. Pat. No. 5,506,625, issued to Kim on Apr. 9, 1996 and entitled, "Video signal conversion method for displaying a 4:3 video signal on a 16:9 screen"; U.S. Pat. No. 5,517,252, issued to Plantholt on May 14, 1996 and entitled, "Device for reproducing picture signals in letter-box format"; U.S. Pat. No. 5,537,149, issued to Teraoka, et al. on Jul. 16, 1996 and entitled, "Display device"; U.S. Pat. No. 5,606,228, issued to Shepherd, et al. on Feb. 25, 1997 and entitled, "Television vertical timebase circuit"; U.S. Pat. No. 5,737,123, issued to Donohoe on Apr. 7, 1998 and entitled, "Adjustable-aspect video projection screen"; U.S. Pat. No. 5,825,427, issued to Macleod on Oct. 20, 1998 and entitled, "Image display system"; U.S. Pat. No. RE36,456, issued to Kim on Oct. 20, 1998 and entitled, "Video signal conversion method for displaying a 4:3 video signal an a 16:9 screen"; and U.S. Pat. No. 6,169,568, issued to Shigetomi on Jan. 2, 2001 and entitled, "Liquid crystal display device and entertainment system." All of the foregoing patents are hereby incorporated by reference as if set forth in their entirety herein.

One feature of the invention resides broadly in a wide-angle, shallow-depth, implosion-resistant television cathode ray tube (20), comprising:

a glass faceplate (24);

said faceplate (24) comprising a substantially flat faceplate (24) with a first surface (22) which becomes an outer surface and substantially the viewing area of said television tube upon installation in a television set, and with a second surface (26) opposite said first surface (22);

said faceplate (24) being configured and dimensioned for a display width of sixteen units and for a display height of nine units;

a phosphor screen (28) disposed adjacent to said second surface (26), being configured to be responsive to electron beams (70, 72, 74) incident thereon, and being configured to emit visible light on said first surface (22) of said faceplate (24) when excited by electron beams;

a shadow mask (50) disposed adjacent to said phosphor screen (28) and being configured with apertures (52) configured to permit passage of electron beams therethrough;

an electron gun means (68) disposed at a distance away from said shadow mask (50) and being configured to emit electron beams through said apertures (52) of said shadow mask (50);

a glass funnel (10, 100);

said glass funnel (10, 100) comprising (a.), (b.), (c.), (d.), and (e.), where (a.), (b.), (c.), (d.), and (e.) are:

(a.) a solder edge portion (102);

said solder edge portion (102) being soldered to said faceplate (24);

said solder edge portion (102) comprising a substantially rectangular solder edge portion and being dimensioned for a display width of sixteen units and a display height of nine units;

(b.) a cylindrical funnel throat portion (66) configured to mount said electron gun means (68) therein;

(c.) a funnel body portion (32) comprising a truncated substantially pyramidal funnel body portion (32);

(d.) a parabolic transition portion (104) being disposed between said cylindrical funnel throat portion (66) and said pyramidal funnel body portion (32) and forming a funnel throat transition portion (104); and (e.) a curved transition portion (106) being disposed between said pyramidal funnel body portion (32) and said solder edge portion (102) and forming a solder edge transition portion (106);

said solder edge portion (102) having a pair of substantially parallel, vertical, solder edges (126, 128) which respectively become a right vertical solder edge (126) and a left vertical solder edge (128) upon installation of said glass funnel (19, 100) in a television set, and said solder edge portion (102) having a pair of substantially parallel, horizontal, solder edges (130, 132) which respectively become an upper solder edge (130) and a lower solder edge (132) upon installation of said glass funnel (10, 100) in a television set;

said upper solder edge (130) being connected with said vertical solder edges (126, 128) to form an upper, right, solder edge corner (134) and an upper, left, solder edge corner (136) upon installation of said glass funnel (10, 100) in a television set;

said lower solder edge (132) being connected with said vertical solder edges (126, 128) to form a lower, right, solder edge corner (138) and a lower, left, solder edge corner (140);

said upper, right, solder edge corner (134) and said lower, left, solder edge corner (140) defining a first diagonal plane (D1) being disposed substantially perpendicular to said faceplate (24) and being disposed between said upper, right, solder edge corner (134) and said lower, left, solder edge corner (140);

said upper, left, solder edge corner (136) and said lower, right, solder edge corner (138) defining a second diagonal plane (D2) being disposed substantially perpendicular to said faceplate (24) and being disposed between said upper, left, solder edge corner (136) and said lower, right, solder edge corner (138);

said pair of vertical solder edges (126, 128) comprising respective midpoints (126*a*, 128*a*), said midpoints (126*a*, 128*a*) being disposed substantially equidistant from said pair of horizontal solder edges (130, 132), and said midpoints (126*a*, 128*a*) defining a horizontal plane (A—A) being disposed substantially perpendicular to said faceplate (24);

said pair of horizontal solder edges (130, 132) comprising respective midpoints (130*a*, 132*a*), said midpoints (130*a*, 132*a*) being disposed substantially equidistant from said pair of vertical solder edges (126, 128), and said midpoints (130*a*, 132*a*) defining a vertical plane (B—B) being disposed substantially perpendicular to said faceplate (24);

an intersection between said horizontal plane (A—A) and said pyramidal funnel body portion (32) defining a right horizontal straight linear portion (126*b*) on the right surface of said pyramidal funnel body portion (32), and a left horizontal straight linear portion (128*b*) on the left surface of said pyramidal funnel body portion (32);

an intersection between said vertical plane (B—B) and said pyramidal funnel body portion (32) defining an upper, vertical, straight linear portion (130*b*) on the upper surface of said pyramidal funnel body portion (32), and defining a lower, vertical, straight linear portion (132*b*) on the lower surface of said pyramidal funnel body portion (32);

an intersection between said first diagonal plane (D1) and said pyramidal funnel body portion (32) defining a diagonal, right, upper straight linear portion (134*b*) on the upper surface of said pyramidal funnel body portion (32), and defining a diagonal, left, lower straight linear portion (140*b*) on the lower surface of said pyramidal funnel body portion (32);

an intersection between said second diagonal plane (D2) and said pyramidal funnel body portion (32) defining a diagonal, left, upper straight linear portion (136*b*) on the upper surface of said pyramidal funnel body portion (32), and defining a diagonal, right, lower straight linear portion (138*b*) on the lower surface of said pyramidal funnel body portion (32);

all of said straight linear portions (126*b*, 128*b*, 130*b*, 132*b*, 134*b*, 136*b*, 138*b*, 140*b*) extending a substantial portion of the distance from said funnel throat transition portion (104) to said solder edge transition portion (106);

an intersection between said horizontal plane (A—A) and said solder edge transition portion (106) defining a first, horizontal, height (210, $Z_G$), from said solder edge portion (102) to a portion of each corresponding horizontal straight linear portion (126*b*, 128*b*) being closest to said solder edge portion (102);

an intersection between said vertical plane (B—B) and said solder edge transition portion (106) defining a second, vertical, height (310, $Z_K$), from said solder edge portion (102) to a portion of each corresponding vertical straight linear portion (130*b*, 132*b*) being closest to said solder edge portion (102);

an intersection between each said diagonal plane (D1, D2) and its corresponding solder edge transition portion (106) defining a third, diagonal, height (410, $Z_D$), from said solder edge portion (102) to a portion of each corresponding diagonal straight linear portion (134*b*, 136*b*, 138*b*, 140*b*) being closest to said solder edge portion (102);

said first, horizontal, height (210, $Z_G$) being greater than either said second, vertical, height (310, $Z_K$) or said third, diagonal, height (410, $Z_D$);

said horizontal straight linear portion (126*b*) on the right surface of said pyramidal funnel body portion (32), and said horizontal straight linear portion (128*b*) on the left surface of said pyramidal funnel body portion (32) each having a first, horizontal, slope (154, 3.2);

said upper straight linear portion (130*b*) on the upper surface of said pyramidal funnel body portion (32), and said lower straight linear portion (132*b*) on the lower surface of said pyramidal funnel body portion (32) each having a second, vertical, slope (164, 3.3);

said diagonal, right, upper straight linear portion (134*b*) on the upper surface of said pyramidal funnel body portion (32), said diagonal, left, lower straight linear portion (140*b*) on the lower surface of said pyramidal funnel body portion (32), said diagonal, left, upper straight linear portion (136*b*) on the upper surface said pyramidal funnel body portion (32), and said diagonal, right, lower straight linear portion (138*b*) on the lower surface of said pyramidal funnel body portion (32) all having a third, diagonal, slope (174, 3.1);

the steepness of said horizontal slope (154, 3.2) being shallower than either the steepness of said vertical slope (164, 3.3) or the steepness of said diagonal slope (174, 3.1);

the steepness of said diagonal slope (174, 3.1) being shallower than the steepness of said vertical slope (164, 3.3);

said first, horizontal, height (210) from said solder edge portion (102) to said portion of each corresponding horizontal straight linear portion (126*b*, 128*b*) being closest to said solder edge portion (102), being sufficiently great to dispose and configure each of said horizontal straight linear portions (126*b*, 128*b*) to have the shallowest slope (154) of all of said straight linear portions;

said television cathode ray tube (20) further comprising:

a deflection coil arrangement (76) disposed about said parabolic transition portion (104) and configured to deflect electron beams in a timed manner across said faceplate (24);

an internal coating (60) on said pyramidal funnel body portion (32), said coating comprising a conductive coating; and an arrangement (62, 64) configured and disposed to a supply a high voltage electron accelerating potential from a power supply (P) to said internal coating (60);

said glass funnel (10, 100) thus being configured to minimize the height of said pyramidal funnel body portion (32) and thus to permit to position said deflection coil arrangement (76) at a distance from said shadow mask (50) to minimize errors of electron beams (70, 72, 74);

minimize the weight of said glass funnel (10, 100); and minimize risk of implosion;

and to thus form a wide-angle, shallow-depth, implosion-resistant television cathode ray tube (20).

Another feature of the invention resides broadly in a wide-angle, shallow-depth, implosion-resistant television cathode ray tube (20), wherein:

each of said horizontal straight linear portions (126*b*, 128*b*) has a first length (154*d*) extending substantially from said funnel throat transition portion (104) to substantially said solder edge transition portion (106);

each of said vertical straight linear portions (130*b*, 132*b*) has a second length (164*d*);

said first length (154*d*) of each of said horizontal straight linear portions (126*b*, 128*b*) is longer than said second length (164*d*) of each of said vertical straight linear portion (130*b*, 132*b*).

Yet another feature of the invention resides broadly in a wide-angle, shallow-depth, implosion-resistant television cathode ray tube wherein: each of said horizontal straight linear portions (126*b*, 128*b*) comprises substantially all of the distance from said solder edge transition portion (106) to said funnel throat transition portion (104);

each of said vertical straight linear portions (130*b*, 132*b*) comprises a portion of the distance from said solder edge transition portion (104) to said funnel throat transition portion (106);

the ratio of each of said horizontal straight linear portions (126*b*, 128*b*) to the length between said solder edge transition portion (106) and said funnel throat transition portion (104) comprises a first ratio;

the ratio of each said second substantially straight linear portions (126*b*, 128*b*) to the length between said solder edge transition portion (106) and said funnel throat transition portion (104) comprises a second ratio;

said first ratio is greater than said second ratio.

Still another feature of the invention resides broadly in a wide-angle, shallow-depth, implosion-resistant television cathode ray tube (20) comprising all of (i.), (ii.), (iii.), (iv.)x (v.), (vi.), and (vii.)

where (i.) is:

each of said horizontal straight linear portions (126*b*, 128*b*) has a first length (154*d*) extending substantially from said funnel throat transition portion (104) to substantially said solder edge transition portion (106);

each of said vertical straight linear portions (130*b*, 132*b*) has a second length (164*d*);

said first length (154*d*) of each of said horizontal straight linear portions (126*b*, 128*b*) is longer than said second length (164*d*) of each of said vertical straight linear portion (130*b*, 132*b*);

where (ii.) is:

said solder edge transition portion (106) at least at each of said respective midpoints (126*a*, 128*a*) comprises a curved portion (156) connecting each of said horizontal straight linear portions (126*b*, 128*b*) to said solder edge portion (102);

where (iii.) is:

each of said horizontal straight linear portions (126*b*, 128*b*) has a first wall thickness (154*a*, 4.3);

each of said diagonal straight linear portions (134*b*, 136*b*, 138*b*, 140*b*) has a first wall thickness (174*a*, 4.1) adjacent to said funnel throat transition portion (104) and has a second wall thickness (174*b*, 4.2) adjacent to said solder edge transition portion (106);

said first wall thickness (154*a*, 4.3) of each of said horizontal straight linear portions (126*b*, 128*b*) is less than either said first wall thickness (174*a*, 4.1) of each of said diagonal straight linear portions (134*b*, 136*b*, 138*b*, 140*b*) or said second wall thickness (174*b*, 4.2) of each of said diagonal straight linear portions (134*b*, 136*b*, 138*b*, 140*b*);

where (iv.) is:

each of said vertical straight linear portions (130*b*, 132*b*) has a first wall thickness (164*a*, 4.5) adjacent to said funnel throat transition portion (104) which is greater than said first wall thickness (154*a*, 4.3) of each of said horizontal straight linear portions (126*b*, 128*b*);

each of said vertical straight linear portions (130*b*, 132*b*) has a second wall thickness (164*b*, 4.6) adjacent to said solder edge transition portion (106) which is greater than said first wall thickness (154*a*, 4.3) of each of said horizontal straight linear portions (126*b*, 128*b*);

each of said vertical straight linear portions (130*b*, 132*b*) has a third wall thickness (164*c*, 4.7) being respectively disposed between said first wall thickness (164*a*, 4.5) of each of said vertical straight linear portions (130*b*, 132*b*) and said second wall thickness (164*b*, 4.6) of each of said vertical straight linear portions (130*b*, 132*b*);

said third wall thickness (164*c*, 4.7) of each of said vertical straight linear portions (130*b*, 132*b*) is less than either said first wall thickness (164*a*, 4.5) of each of said vertical straight linear portions (130*b*, 132*b*) or said second wall thickness (164*b*, 4.6) of each of said vertical straight linear portions (130*b*, 132*b*);

where (v.) is:

said solder edge portion (102) defines a solder edge plane (103);

said funnel body portion (32) and said funnel throat transition portion (104) are joined at an interface (G);

a distance from said solder edge plane (103) to said interface (G) comprises a funnel body height (212, Z);

each of said horizontal straight linear portions (126*b*, 128*b*) and said interface (G) intersect at a respective first interface point (206*a*);

each said first interface point (206*a*) and a corresponding midpoint (126*a*, 128*a*) defining a respective first straight line (206) therebetween;

each said first straight line (206) and each of said horizontal straight linear portions (126*b*, 128*b*) defining a respective first maximum distance (208, 6.5, $H_{gr}$) therebetween;

each said first maximum distance (208, 6.5, $H_{gr}$) defining a first maximum distance point (206*d*) on said outer surface (34) of said funnel body portion (32);

each said first maximum distance point (206*d*) is disposed at a first solder edge height (210,$Z_G$) from said solder edge plane (103);

the ratio of said funnel body height (212, Z) and each said first solder edge height (210, $Z_G$) is greater than 1.6;

each of said vertical straight linear portions (130*b*, 132*b*) and said interface (G) intersect at a respective second interface point (306*a*);

each said second interface point (306*a*) and a corresponding midpoint (130*a*, 132*a*) defining a respective second straight line (306) therebetween;

each said second straight line (306) and each of said vertical straight linear portions (130*b*, 132*b*) defining a respective second maximum distance (308, 6.6, $H_{k1}$) therebetween;

each said second maximum distance (308, 6.6, $H_{k1}$) defining a respective second maximum distance point (306*d*) on said outer surface (34) of said funnel body portion (32);

each said second maximum distance point (306*d*) is disposed at a respective second solder edge height (310, $Z_K$) from said solder edge plane (103);

the ratio of said funnel body height (212, Z) and each said second solder edge height (310, $Z_K$) is greater than 2.6;

each of said diagonal straight linear portions (134*b*, 136*b*, 138*b*, 140*b*) and said interface (G) intersect at a respective third interface point (406*a*);

each said third interface point (406*a*) and a corresponding solder edge corner (134, 136, 138, 140) defining a respective third straight line (406) therebetween;

each said third straight line (406) and each of said diagonal straight linear portions (134*b*, 136*b*, 138*b*, 140*b*) defining a respective third maximum distance (408, 6.4, $H_{dia}$) therebetween;

each said third maximum distance (408, 6.4, $H_{dia}$) defining a respective third maximum distance point (406*d*) on said outer surface (34) of said funnel body portion (32);

each said third maximum distance point (406*d*) is disposed at a respective third solder edge height (410, $Z_D$) from said solder edge plane (103);

the ratio of said funnel body height (212, Z) and each said third solder edge height (410, $Z_D$) is greater than 2.5;

where (vi.) is:

said solder edge plane (103) comprises a straight diagonal length (D);

the ratio of said straight diagonal length (D) and each said first maximum distance (208, 6.5, $H_{gr}$) is less than 25;

the ratio of said straight diagonal length (D) and each said second maximum distance (308, 6.6, $H_{k1}$) is greater than 33;

the ratio of said straight diagonal length (D) and each said third maximum distance (408, 6.4, $H_{dia}$) is greater than 28;

said solder edge portion (102) comprises a substantially rectangular solder edge portion (102);

where (vii.) is:

said funnel throat transition portion (104) comprises a portion having a cross-sectional configuration defined by substantially straight portions (214) to connect said cylindrical funnel throat (66) to said rectangular solder edge portion (102);

said faceplate (24) comprises a recessed peripheral portion (216);

said solder edge portion (102) comprises an elongated peripheral portion (218) to interlock with said recessed peripheral portion (216) of said faceplate (24).

A further feature of the invention reside broadly in a wide-angle, shallow-depth cathode ray tube comprising:

a glass faceplate (24);

said faceplate (24) comprising a substantially flat faceplate with a first surface (22) which becomes an outer surface and substantially the viewing area of said cathode ray tube upon installation, and with a second surface (26) opposite said first surface;

a phosphor screen (28) being disposed adjacent to said second surface (26), being configured to be responsive to electron beams (70, 72, 74) incident thereon, and being configured to emit visible light on said first surface (22) of said faceplate (24) when excited by electron beams;

an electron gun means (68) being disposed at a distance away from said phosphor screen (28) and being configured to emit electron beams (70, 72, 74); and a wide-angle, shallow-depth glass funnel (10, 100);

said glass funnel (10, 100) comprising (a.), (b.), (c.), (d.), and (e.), where (a.), (b.), (c.), (d.), and (e.) are:

(a.) a solder edge portion (102);

said solder edge portion (102) being soldered to said faceplate (24), said solder edge portion (102) comprising a substantially rectangular solder edge portion (102);

(b.) a cylindrical funnel throat portion (66) having said electron gun means (68) mounted therein;

(c.) a funnel body portion (32) comprising a truncated substantially pyramidal funnel body portion (32), said pyramidal funnel body portion defining a central axis (56, C1) being disposed substantially perpendicular to said solder edge portion (102), and said pyramidal funnel body portion (32) comprising an outer surface (34);

(d.) a first transition portion (104) being disposed between said cylindrical funnel throat portion (66) and said pyramidal funnel body portion (32) and forming a funnel throat transition portion (104); and (e.) a second transition portion (106) being disposed between said pyramidal funnel body portion (32) and said solder edge portion (102) and forming a solder edge transition portion (106);

said solder edge portion (102) having a first solder edge (126) and a second solder edge (130) joined to said first solder edge (126);

said first solder edge (126) and said second solder edge (130) being connected to one another at a corner (134);

said first solder edge (126) comprising a first length (134–138), said first length comprising a first midpoint (126*a*), said first midpoint (126*a*) and said central axis (56, C1) defining a first plane (A—A) being disposed substantially perpendicular to said solder edge portion (102);

said second solder edge (130) comprising a second length comprising a second midpoint (130*a*), said second midpoint (130*a*) and said central axis (56, C1) defining a second plane (B—B) being disposed substantially perpendicular to said solder edge portion (102);

said corner (134) and said central axis (56, C1) defining a third plane (D1) being disposed substantially perpendicular to said solder edge portion (102);

the intersection between said first plane (A—A) and said pyramidal funnel body portion (32) defining a first straight linear portion (126*b*) being disposed on said outer surface (34) of said pyramidal funnel body portion (32);

the intersection between said second plane (B—B) and said pyramidal funnel body (32) defining a second straight linear portion (130*b*) on said outer surface (34) of said pyramidal funnel body portion (32);

the intersection between said third plane (D1) and said pyramidal funnel body portion (32) defining a third straight linear portion (134*b*) on said outer surface (34) of said pyramidal funnel body portion (32);

all of said straight linear portions (126*b*, 130*b*, 134*b*) extending a substantial portion of the distance from said funnel throat transition portion (104) to said solder edge transition portion (106);

the intersection of said first plane (A—A) and said solder edge transition portion (106) defining a first height (210, $Z_G$) from said solder edge portion (102) to a portion of said first straight linear portion (126*b*) being closest to said solder edge portion (102);

the intersection of said second plane (B—B) and said solder edge transition portion (106) defining a second height (310, $Z_K$) from said solder edge portion (102) to a portion of said second straight linear portion (130*b*) being closest to said solder edge portion (102);

the intersection of said third planes (D1) and said solder edge transition portion (106) defining a third height (410, $Z_D$) from said solder edge portion (102) to a portion of said third straight linear portion (134*b*) being closest to said solder edge portion (102);

said first height (210, $Z_G$), from said solder edge portion (102) to said portion of said first straight linear portion (126*b*) being closest to said solder edge portion (102), being greater than either said second height (310, $Z_K$) or said third height (410, $Z_D$) and being sufficiently great to dispose and configure said first straight linear portion (126*b*) to have the shallowest slope of all of said three straight linear portions (126*b*, 130*b*, 134*b*);

said glass funnel (10, 100) thus being configured to minimize the height of said funnel body portion (32);

and to thus configure a wide-angle, shallow-depth, cathode ray tube (20).

Another feature of the invention resides broadly in a wide-angle, shallow-depth cathode ray tube (20) wherein:

said first straight linear portion (126*b*) has a first length (154*d*) extending substantially from said funnel throat transition portion (104) to substantially said solder edge transition portion (106);

said second straight linear portions (130*b*) has a second length (164*d*);

said first length (154*d*) of said first straight linear portion (126*b*) is longer than said second length (164*d*) of said second straight linear portion (130*b*).

Yet another feature of the invention resides broadly in a wide-angle, shallow-depth cathode ray tube wherein:

said first straight linear portion (126*b*) comprises substantially all of the distance from said solder edge transition portion (106) to said funnel throat transition portion (104);

said second straight linear portion (130*b*) comprises a portion of the distance from said solder edge transition portion (106) to said funnel throat transition portion (104);

the ratio of said first straight linear portion (130*b*) to the length between said solder edge transition portion (106) and said funnel throat transition portion (104) comprises a first ratio;

the ratio of said second straight linear portion to the length between said solder edge transition portion (106) and said funnel throat transition portion (104) comprises a second ratio;

said first ratio is greater than said second ratio.

Still another feature of the invention resides broadly in a wide-angle, shallow-depth cathode ray tube (20) comprising all of (i.), (ii.), (iii.), (iv.), (v.), (vi.), (vii.), and (viii):

where (i.) is:

said first straight linear portion (126*b*) has a first length (154*d*) extending substantially from said funnel throat transition portion (104) to substantially said solder edge transition portion (106);

said second straight linear portions (130*b*) has a second length (164*d*);

said first length (154*d*) of said first straight linear portion (126*b*) is longer than said second length (164*d*) of said second straight linear portion (130*b*);

where (ii.) is:

said solder edge transition portion (106) at said midpoint (126*a*) comprises a curved portion (156) connecting said first straight linear portion (126*b*) to said solder edge portion (102);

where (iii.) is:

said first straight linear portion (126*b*) has a first wall thickness (154*a*, 4.3);

said third straight linear portion (134*b*) has a first wall thickness (174*a*, 4.1) adjacent to said funnel throat transition portion (104) and has a second wall thickness (174*b*, 4.2) adjacent to said solder edge transition portion (106);

said first wall thickness (154*a*, 4.3) of said first straight linear portion (126*b*) is less than either said first wall thickness (174*a*, 4.1) of said third straight linear portion (134*b*) or said second wall thickness (174*b*, 4.2) of said third straight linear portion (134*b*);

where (iv.) is:

said second straight linear portion (130*b*) has a first wall thickness (164*a*, 4.5) adjacent to said funnel throat transition portion (104) which is greater than said first wall thickness (154*a*, 4.3) of said first straight linear portion (126*b*);

said second straight linear portion (130*b*) has a second wall thickness (164*b*, 4.6) adjacent to said solder edge transition portion (106) which is greater than said first wall thickness (154*a*, 4.3) of said first straight linear portion (126*b*);

said second straight linear portion (130*b*) has a third wall thickness (164*c*, 4.7) being disposed between said first wall thickness (164*a*, 4.5) of said second straight linear portion (130*b*) and said second wall thickness (164*b*, 4.6) of said second straight linear portion (130*b;* said third wall thickness (164*c*, 4.7) of said second straight linear portion (130*b*) is less than either said first wall thickness (164*a*, 4.5) of said second straight linear portion (130*b*) or said second wall thickness (164*b*, 4.6) of said second straight linear portion (130*b*);

where (v.) is:

said solder edge portion (102) defines a solder edge plane (103);

said funnel body portion (32) and said funnel throat transition portion (104) are joined at an interface (G);

a distance from said solder edge plane (103) to said interface (G) comprises a funnel body height (212, Z);

said first straight linear portion (126*b*) and said interface (G) intersect at a first interface point (206*a*);

said first interface point (206*a*) and said first midpoint (126*a*) defining a first straight line (206) therebetween;

said first straight line (206) and said first straight linear portion (126*b*) defining a first maximum distance (208, 6.5, $H_{gr}$) therebetween;

said first maximum distance (208, 6.5, $H_{gr}$) defining a first maximum distance point (206*d*) on said outer surface (34) of said funnel body portion (32);

said first maximum distance point (206*d*) is disposed at a first solder edge height (21, $Z_G$) from said solder edge plane (103);

the ratio of said funnel body height (212, Z) and said first solder edge height (210, $Z_G$) is greater than 1.6;

said second straight linear portion (130*b*) and said interface (G) intersect at a second interface point (306*a*);

said second interface point (306*a*) and said second midpoint (130*a*) defining a second straight line (306) therebetween;

said second straight line (306) and said second straight linear portion (130*b*) defining a second maximum distance (308, 6.6, $H_{k1}$) therebetween;

said second maximum distance (308, 6.6, $H_{k1}$) defining a second maximum distance point (306*d*) on said outer surface (34) of said funnel body portion (32);

said second maximum distance point (306*d*) is disposed at a second solder edge height (310, $Z_K$) from said solder edge plane (103);

the ratio of said funnel body height (212, Z) and said second solder edge height (310, $Z_K$) is greater than 2.6;

said third straight linear portion (134*b*) and said interface (G) intersect at a third interface point (406*a*);

said third interface point (406*a*) and said solder edge corner (134) defining a third straight line (406) therebetween;

said third straight line (406) and said third straight linear portion (134*b*) defining a third maximum distance (408, 6.4, $H_{dia}$) therebetween;

said third maximum distance (408, 6.4, $H_{dia}$) defining a third maximum distance point (406*d*) on said outer surface (34) of said funnel body portion (32);

said third maximum distance point (406*d*) is disposed at a third solder edge height (410, $Z_D$) from said solder edge plane (103);

the ratio of said funnel body height (212, Z) and said third solder edge height (410, $Z_D$) is greater than 2.5;

(where (vi.) is:

said solder edge plane (103) comprises a straight diagonal length (D);

the ratio of said straight diagonal length (D) and said first maximum distance (208, 6.5, $H_{gr}$) is less than 25;

the ratio of said straight diagonal length (D) and said second maximum distance (308, 6.6, Hk1) is greater than 33;

the ratio of said straight diagonal length (D) and said third maximum distance (408, 6.4, $H_{dia}$) is greater than 28;

where (vii.) is:

said funnel throat transition portion (104) comprises a portion having a cross-sectional configuration defined by substantially straight portions (214) to connect said said cylindrical funnel throat (66) to said rectangular solder edge portion (102);

where (viii.) is:

said faceplate (24) comprises a recessed peripheral portion (216); and said solder edge portion (102) comprises an elongated peripheral portion (218) to interlock with said recessed peripheral portion (216) of said faceplate (24).

A further feature of the invention resides broadly in a glass funnel (10, 100) for a cathode ray tube (20), said glass funnel (10, 100) comprising:

(a.) a solder edge structure (102);

said solder edge structure (102) being configured to receive a faceplate (24) for a cathode ray tube (20) and said solder edge structure defining a solder edge plane (103) thereat;

(b.) a cylindrical funnel throat (66) configured to mount therein electron gun means (68) of a cathode ray tube (20);

(c.) a funnel body (32);

said funnel body (32) having an outer surface (34) and said funnel body (32) defining a central axis (56, C1) being disposed substantially perpendicular to said solder edge plane (103);

(d.) a first, funnel throat, transition portion (104) disposed between said cylindrical funnel throat (66) and said funnel body (32); and (e.) a second, solder edge, transition portion (106) disposed between said funnel body (32) and said solder edge structure (102);

said solder edge structure (102) having a first substantially linear solder edge (126) and a second substantially linear solder edge (130) joining said first substantially linear solder edge (126);

said first substantially linear solder edge (126) being disposed transverse to said second substantially linear solder edge (130);

said first substantially linear solder edge (126) and said second substantially linear solder edge (130) being connected to one another at a corner (134);

said first substantially linear solder edge (126) comprising a first length (134–138) comprising a first midpoint (126*a*);

a first region (126*b*) extending from said first midpoint (126*a*) towards said central axis (56, C1) across said solder edge transition portion (106) and across said funnel body, (32) to said funnel throat transition portion (104);

said first region (126*b*) comprising a first substantially straight linear portion (154) being disposed on said outer surface (34) of said funnel body (32);

said second substantially linear solder edge (130) comprising a second length (134–136) comprising a second midpoint (130*a*);

a second region (130*b*) extending from said second midpoint (130*a*) towards said central axis (56, C1) across said solder edge transition portion (106) and across said funnel body (32) to said funnel throat transition portion (104);

said second region (130*b*) comprising a second substantially straight linear portion (164) being disposed on said outer surface (34) of said funnel body (32);

a third region (134*b*) extending from said corner (134) towards said central axis (56, C1) across said solder edge transition portion (106) and across said funnel body (32) to said funnel throat transition portion (104); and said third region (134*b*) comprising a third, diagonal, substantially straight linear portion (174) being disposed on said outer surface (34) of said funnel body (32).

Another feature of the invention resides broadly in a glass funnel, wherein:

said solder edge transition portion (106), at least at said first region (126*b*), from said first substantially straight linear portion (154) to said first solder edge midpoint (126*a*), being sufficiently high, at a portion of said first substantially straight linear portion (154) being closest to said solder edge plane (103), to configure said first substantially straight linear portion (154) to have the shallowest steepness (154) of all of said three substantially straight linear portions (154, 164, 174);

all of said substantially straight linear portions (154, 164, 174) extending a substantial portion of the distance from said funnel throat transition portion (104) to said solder edge transition portion (106).

Yet another feature of the invention resides broadly in a glass funnel wherein:

said first substantially straight linear portion (154) has a first length (154*d*);

said second substantially straight linear portion (164) has a second length (164*d*);

said first length (154*d*) of said first substantially straight linear portion (154) is longer than said second length (164*d*) of said second substantially straight linear portion (164).

Still another feature of the invention resides broadly in a glass funnel wherein:

said solder edge transition portion (106) at least at said first region (126*b*) comprises a curved portion (156) connecting said first substantially straight linear portion (154) to said solder edge structure (102).

A further feature of the invention resides broadly in a glass funnel wherein:

said first substantially straight linear portion (154) has a first wall thickness (154*a*, 4.3);

said third substantially straight linear portion (174) has a first wall thickness (174*a*, 4.1) adjacent to said funnel throat transition portion (104) and has a second wall thickness (174*b*, 4.2) adjacent to said solder edge transition portion (106);

said first wall thickness (154*a*, 4.3) of said first substantially straight linear portion (154) is less than either said first wall thickness (174*a*, 4.1) of said third substantially straight linear portion (174) or said second wall thickness (174*b*, 4.2) of said third substantially straight linear portion (174).

Another feature of the invention resides broadly in a glass funnel wherein:

said second substantially straight linear portion (164) has a first wall thickness (164*a*, 4.5) adjacent to said funnel throat transition portion (104) which is greater than said first wall thickness (154*a*, 4.3) of said first substantially straight linear portion (154);

said second substantially straight linear portion (164) has a second wall thickness (164*b*, 4.6) adjacent to said solder edge transition portion (106) which is greater than said first wall thickness (154*a*, 4.3) of said first substantially straight linear portions (154); and said second substantially straight linear portion (164) has a third wall thickness (164*c*, 4.7) being disposed between said first and wall thickness (164*a*, 4.5) of said second substantially straight linear portion (164) and said second wall thickness (164*b*, 4.6) of said second substantially straight linear portion (164);

said third wall thickness (164*c*, 4.7) of said second substantially straight linear portion (164) is less than either said first wall thickness (164*a*, 4.5) of said second substantially straight linear portion (164) or said second wall thickness (164*b*, 4.6) of said second substantially straight linear portion (164).

Yet another feature of the invention resides broadly in a glass funnel wherein:

said funnel body (32) and said funnel throat transition portion (104) are joined at an interface (G);

a distance from said solder edge plane (103) to said interface (G) along said central axis (56, C1) comprises a funnel body height (212, Z);

said first region (126*b*) and said interface (G) intersect at a first interface point (206*a*);

said first interface point (206*a*) and said first solder edge midpoint (126*a*) defining a first straight line (206) therebetween;

said first straight line (206) and said first region (126*b*) defining a first maximum distance (208, 6.5, $H_{gr}$) therebetween;

said first maximum distance (208, 6.5, $H_{gr}$) defining a first maximum distance point (206*d*) on said outer surface (34) of said funnel body (32);

said first maximum distance point (206*d*) being disposed at a first solder edge height (210, $Z_G$) from said solder edge plane (103);

the ratio of said funnel body height (212, Z) and said first solder edge height (210, $Z_G$) is greater than 1.6;

said second region (130*b*) and said interface (G) intersect at a second interface point (306*a*);

said second interface point (306*a*) and said second solder edge midpoint (130*a*) defining a second straight line (306) therebetween;

said second straight line (306) and said second region (130*b*) defining a second maximum distance (308, 6.6, $H_{k1}$) therebetween;

said second maximum distance (308, 6.6, $H_{k1}$) defining a second maximum distance point (306*d*) on said outer surface (34) of said funnel body (32);

said second maximum distance point (306*d*) being disposed at a second solder edge height (310, $Z_K$) from said solder edge plane (103);

the ratio of said funnel body height (212, Z) and said second solder edge height (310, $Z_K$) is greater than 2.6;

said third region (134*b*) and said interface (G) intersect at a third interface point (406*a*);

said third interface point (406*a*) and said corner (134, 406*b*) defining a third straight line (406) therebetween;

said third straight line (406) and said third region (134*b*) defining a third maximum distance (408, 6.4, $H_{dia}$) therebetween;

said third maximum distance (408, 6.4, $H_{dia}$) defining a third maximum distance point (406*d*) on said outer surface (34) of said funnel body (32);

said third maximum distance point (406*d*) is disposed at a third solder edge height (410, $Z_D$) from said solder edge plane (103); and the ratio of said funnel body height (212, Z) and said third solder edge height (410, $Z_D$) is greater than 2.5.

Still another feature of the invention resides broadly in a glass funnel wherein:

said solder edge plane (103) comprises a straight diagonal length (D);

the ratio of said straight diagonal length (D) and said first maximum distance (208, 6.5, $H_{gr}$) is less than 25;

the ratio of said straight diagonal length (D) and said second maximum distance (308, 6.6, Hk1) is greater than 33; and the ratio of said straight diagonal length (D) and said third maximum distance (408, 6.4, $H_{dia}$) is greater than 28.

A further feature of the invention resides broadly in a glass funnel wherein:

said solder edge structure (102) comprises a substantially rectangular solder edge structure (102);

said funnel throat transition portion (104) comprises a portion having a cross-sectional configuration defined by substantially straight portions (214) to connect said cylindrical funnel throat (66) to said rectangular solder edge structure (102).

Another feature of the invention resides broadly in a glass funnel wherein said solder edge structure (102) is configured to interlock with a faceplate (24) comprising a recessed peripheral portion (216); and said solder edge structure (102) comprises an elongated peripheral portion (218) to interlock with said recessed peripheral portion (216) of said faceplate (24).

Yet another feature of the invention resides broadly in a glass funnel wherein:

said first substantially straight linear portion (126*b*) comprises substantially all of the distance from said solder edge transition portion (106) to said funnel throat transition portion (104);

said second substantially straight linear portion (128*b*) comprises a portion of the distance from said solder edge transition portion (106) to said funnel throat transition portion (104);

the ratio of said first substantially straight linear portion (126*b*) to the length of said first region between said solder edge transition portion (106) and said funnel throat transition portion (104) comprises a first ratio;

the ratio of said second substantially straight linear portion (128*b*) to the length of said second region between said solder edge transition portion (106) and said funnel throat transition portion (104) comprises a second ratio;

said first ratio is greater than said second ratio.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The features of the invention as described hereinabove in the context of the preferred embodiments is not to be taken as limited to all of the provided details thereof, since modifications and variations thereof may be made without departing from the spirit and scope of the invention.

AT LEAST PARTIAL INDEX OF REFERENCE NUMERALS

1 funnel throat
2 parabolic area
3.1 diagonal
3.2 major axis
3.3 minor axis
3.4 area on 3.3
4.1 wall thickness
4.2 wall thickness
4.3 wall thickness
4.4 wall thickness
4.5 wall thickness
4.6 wall thickness
4.7 wall thickness
6.1 interface
6.2 external transition
6.3 outer edge
6.4 maximum distance ($H_{dia}$)
6.5 maximum distance ($H_{gr}$)
6.6 maximum distance ($H_{k1}$)
7 solder edge
8 funnel body
10 glass funnel
20 television cathode ray tube
22 first surface of 24
24 faceplate
26 second/inner surface of 24
28 phosphor screen
30 aluminum film
32 funnel body portion/funnel body
34 outer surface
48A rail
48B rail
50 shadow mask
52 apertures in 50
56 central axis (C1)
60 internal coating
62&64 arrangement to supply high voltage potential
66 cylindrical funnel throat
68 electron gun means
70 electron beam
72 electron beam
74 electron beam
76 deflection coil arrangement
78 spring
80 metal cap
100 glass funnel
102 solder edge portion/structure
103 solder edge plane
104 first, parabolic, funnel throat transition portion
106 second solder edge curved transition portion
126 right solder edge
126*a* midpoint
126*b* right horizontal straight linear portion/region
128 left solder edge
128*a* midpoint
128*b* left horizontal straight linear portion
130 upper solder edge
130*a* midpoint
130*b* upper vertical straight linear portion/region
132 lower solder edge
132*a* midpoint
132*b* lower vertical straight linear portion
134 upper right corner
134*b* diagonal right upper straight linear portion/region
136 upper left corner
136*b* diagonal left upper straight linear portion
138 lower right corner
138*b* diagonal right lower straight linear portion
140 lower left corner
140*b* diagonal left lower straight linear portion
154 horizontal slope
154*a* first wall thickness of 154
154*b* second wall thickness of 154
154*d* length of 154
156 curved portion
164 vertical slope
164*a* first wall thickness of 164
164*b* second wall thickness of 164
164*c* third wall thickness of 164
164*d* length of 164
174 diagonal slope
174*a* first wall thickness of 174
174*b* second wall thickness of diagonal
200 height of 104
206 first straight line—horizontal
206*a* first interface point
206*b* second terminus of 206
206*c* first terminus of 208
206*d* first maximum distance point
206*e* terminus of 126*b*
208 first maximum distance
210 solder edge height
212 funnel body height
214 straight side in 66
216 peripheral portion of 24
218 peripheral portion of 102
220 thickness of 102
222 thickness
224 reinforcement
226 attachment portion
228 web thickness
306 second straight line—vertical
306*a* second interface point
306*b* second terminus of 306
306*c* first terminus of 308
306*d* second maximum distance point
308 second maximum distance
310 second solder edge height
406 third straight line—diagonal
406*a* third interface point
406*b* second terminus of 406
406*c* first terminus of 408
406*d* third maximum distance point
408 third maximum distance
410 third solder edge height
A—A horizontal
B—B vertical
C1 center
D1 diagonal (from 134 to 140)
D2 diagonal (from 136 to 138)
E interface
F interface
G interface
H interface
I interface
J interface K interface
Z funnel body height
$Z_D$ third solder edge height
$Z_K$ first solder edge height
$Z_K$ second solder edge height

What is claimed is:

1. A wide-angle, shallow-depth, implosion-resistant television cathode ray tube, comprising:

a glass faceplate;

said faceplate comprising a substantially flat faceplate with a first surface which becomes an outer surface and substantially the viewing area of said television tube upon installation in a television set, and with a second surface opposite said first surface;

said faceplate being configured and dimensioned for a display width of sixteen units and for a display height of nine units;

a phosphor screen disposed adjacent to said second surface, being configured to be responsive to electron beams incident thereon, and being configured to emit visible light on said first surface of said faceplate when excited by electron beams;

a shadow mask disposed adjacent to said phosphor screen and being configured with apertures configured to permit passage of electron beams therethrough;

an electron gun means disposed at a distance away from said shadow mask and being configured to emit electron beams through said apertures of said shadow mask;

a glass funnel;

said glass funnel comprising (a.), (b.), (c.), (d.), and (e.), where (a.), (b.), (c.), (d.), and (e.) are:

(a.) a solder edge portion;

said solder edge portion being soldered to said faceplate;

said solder edge portion comprising a substantially rectangular solder edge portion and being dimensioned for a display width of sixteen units and a display height of nine units;

(b.) a cylindrical funnel throat portion configured to mount said electron gun means therein;

(c.) a funnel body portion comprising a truncated substantially pyramidal funnel body portion;

(d.) a parabolic transition portion being disposed between said cylindrical funnel throat portion and said pyramidal funnel body portion and forming a funnel throat transition portion; and (e.) a curved transition portion being disposed between said pyramidal funnel body portion and said solder edge portion and forming a solder edge transition portion;

said solder edge portion having a pair of substantially parallel, vertical, solder edges which respectively become a right vertical solder edge and a left vertical solder edge upon installation of said glass funnel in a television set, and said solder edge portion having a pair of substantially parallel, horizontal, solder edges which respectively become an upper solder edge and a lower solder edge upon installation of said glass funnel in a television set;

said upper solder edge being connected with said vertical solder edges to form an upper, right, solder edge corner and an upper, left, solder edge corner upon installation of said glass funnel in a television set;

said lower solder edge being connected with said vertical solder edges to form a lower, right, solder edge corner and a lower, left, solder edge corner;

said upper, right, solder edge corner and said lower, left, solder edge corner defining a first diagonal plane being disposed substantially perpendicular to said faceplate and being disposed between said upper, right, solder edge corner and said lower, left, solder edge corner;

said upper, left, solder edge corner and said lower, right, solder edge corner defining a second diagonal plane being disposed substantially perpendicular to said faceplate and being disposed between said upper, left, solder edge corner and said lower, right, solder edge corner;

said pair of vertical solder edges comprising respective midpoints, said midpoints being disposed substantially equidistant from said pair of horizontal solder edges, and said midpoints defining a horizontal plane being disposed substantially perpendicular to said faceplate;

said pair of horizontal solder edges comprising respective midpoints, said midpoints being disposed substantially equidistant from said pair of vertical solder edges, and said midpoints defining a vertical plane being disposed substantially perpendicular to said faceplate;

an intersection between said horizontal plane and said pyramidal funnel body portion defining a right horizontal straight linear portion on the right surface of said pyramidal funnel body portion, and a left horizontal straight linear portion on the left surface of said pyramidal funnel body portion;

an intersection between said vertical plane and said pyramidal funnel body portion defining an upper, vertical, straight linear portion on the upper surface of said pyramidal funnel body portion, and defining a lower, vertical, straight linear portion on the lower surface of said pyramidal funnel body portion;

an intersection between said first diagonal plane and said pyramidal funnel body portion defining a diagonal, right, upper straight linear portion on the upper surface of said pyramidal funnel body portion, and defining a diagonal, left, lower straight linear portion on the lower surface of said pyramidal funnel body portion;

an intersection between said second diagonal plane and said pyramidal funnel body portion defining a diagonal, left, upper straight linear portion on the upper surface of said pyramidal funnel body portion, and defining a diagonal, right, lower straight linear portion on the lower surface of said pyramidal funnel body portion;

all of said straight linear portions extending a substantial portion of the distance from said funnel throat transition portion to said solder edge transition portion;

an intersection between said horizontal plane and said solder edge transition portion defining a first, horizontal, height, from said solder edge portion to a portion of each corresponding horizontal straight linear portion being closest to said solder edge portion;

an intersection between said vertical plane and said solder edge transition portion defining a second, vertical, height, from said solder edge portion to a portion of each corresponding vertical straight linear portion being closest to said solder edge portion;

an intersection between each said diagonal plane and its corresponding solder edge transition portion defining a third, diagonal, height, from said solder edge portion to a portion of each corresponding diagonal straight linear portion being closest to said solder edge portion;

said first, horizontal, height being greater than either said second, vertical, height or said third, diagonal, height;

said horizontal straight linear portion on the right surface of said pyramidal funnel body portion, and said horizontal straight linear portion on the left surface of said pyramidal funnel body portion each having a first, horizontal, slope;

said upper straight linear portion on the upper surface of said pyramidal funnel body portion, and said lower straight linear portion on the lower surface of said pyramidal funnel body portion each having a second, vertical, slope;

said diagonal, right, upper straight linear portion on the upper surface of said pyramidal funnel body portion, said diagonal, left, lower straight linear portion on the lower surface of said pyramidal funnel body portion, said diagonal, left, upper straight linear portion on the upper surface said pyramidal funnel body portion, and said diagonal, right, lower straight linear portion on the lower surface of said pyramidal funnel body portion all having a third, diagonal, slope;

the steepness of said horizontal slope being shallower than either the steepness of said vertical slope or the steepness of said diagonal slope;

the steepness of said diagonal slope being shallower than the steepness of said vertical slope;

said first, horizontal, height from said solder edge portion to said portion of each corresponding horizontal straight linear portion being closest to said solder edge portion, being sufficiently great to dispose and configure each of said horizontal straight linear portions to have the shallowest slope of all of said straight linear portions;

said television cathode ray tube further comprising:

a deflection coil arrangement disposed about said parabolic transition portion and configured to deflect electron beams in a timed manner across said faceplate;

an internal coating on said pyramidal funnel body portion, said coating comprising a conductive coating; and an arrangement configured and disposed to a supply a high voltage electron accelerating potential from a power supply to said internal coating;

said glass funnel thus being configured to minimize the height of said pyramidal funnel body portion and thus to permit to position said deflection coil arrangement at a distance from said shadow mask to minimize errors of electron beams;

minimize the weight of said glass funnel; and minimize risk of implosion;

and to thus form a wide-angle, shallow-depth, implosion-resistant television cathode ray tube.

2. The wide-angle, shallow-depth, implosion-resistant television cathode ray tube according to claim 1, wherein:

each of said horizontal straight linear portions has a first length extending substantially from said funnel throat transition portion to substantially said solder edge transition portion;

each of said vertical straight linear portions has a second length;

said first length of each of said horizontal straight linear portions is longer than said second length of each of said vertical straight linear portion.

3. The wide-angle, shallow-depth, implosion-resistant television cathode ray tube according to claim 2, wherein:

each of said horizontal straight linear portions comprises substantially all of the distance from said solder edge transition portion to said funnel throat transition portion;

each of said vertical straight linear portions comprises a portion of the distance from said solder edge transition portion to said funnel throat transition portion;

the ratio of each of said horizontal straight linear portions to the length of said first region between said solder edge transition portion and said funnel throat transition portion comprises a first ratio;

the ratio of said second substantially straight linear portion to the length of said second region between said solder edge transition portion and said funnel throat transition portion comprises a second ratio;

said first ratio is greater than said second ratio.

4. The wide-angle, shallow-depth, implosion-resistant television cathode ray tube according to claim 1 comprising all of (i.), (ii.), (iii.),(iv.), (v.), (v.), (vi.), and (vii.):

where (i.) is:

each of said horizontal straight linear portions has a first length extending substantially from said funnel throat transition portion to substantially said solder edge transition portion;

each of said vertical straight linear portions has a second length;

said first length of each of said horizontal straight linear portions is longer than said second length of each of said vertical straight linear portion;

where (ii.) is:

said solder edge transition portion at least at each of said respective midpoints comprises a curved portion connecting each of said horizontal straight linear portions to said solder edge portion;

where (iii.) is:

each of said horizontal straight linear portions has a first wall thickness;

each of said diagonal straight linear portions has a first wall thickness adjacent to said funnel throat transition portion and has a second wall thickness adjacent to said solder edge transition portion;

said first wall thickness of each of said horizontal straight linear portions is less than either said first wall thickness of each of said diagonal straight linear portions or said second wall thickness of each of said diagonal straight linear portions;

where (iv.) is:

each of said vertical straight linear portions has a first wall thickness adjacent to said funnel throat transition portion which is greater than said first wall thickness of each of said horizontal straight linear portions;

each of said vertical straight linear portions has a second wall thickness adjacent to said solder edge transition portion which is greater than said first wall thickness of each of said horizontal straight linear portions;

each of said vertical straight linear portions has a third wall thickness being respectively disposed between said first wall thickness of each of said vertical straight linear portions and said second wall thickness of each of said vertical straight linear portions;

said third wall thickness of each of said vertical straight linear portions is less than either said first wall thickness of each of said vertical straight linear portions or said second wall thickness of each of said vertical straight linear portions;

where (v.) is:

said solder edge portion defines a solder edge plane;

said funnel body portion and said funnel throat transition portion are joined at an interface;

a distance from said solder edge plane to said interface comprises a funnel body height;

each of said horizontal straight linear portions and said interface intersect at a respective first interface point;

each said first interface point and a corresponding midpoint defining a respective first straight line therebetween;

each said first straight line and each of said horizontal straight linear portions defining a respective first maximum distance therebetween;

each said first maximum distance defining a first maximum distance point on said outer surface of said funnel body portion;

each said first maximum distance point is disposed at a first solder edge height from said solder edge plane;

the ratio of said funnel body height and each said first solder edge height is greater than 1.6;

each of said vertical straight linear portions and said interface intersect at a respective second interface point;

each said second interface point and a corresponding midpoint defining a respective second straight line therebetween;

each said second straight line and each of said vertical straight linear portions defining a respective second maximum distance therebetween;

each said second maximum distance defining a respective second maximum distance point on said outer surface of said funnel body portion;

each said second maximum distance point is disposed at a respective second solder edge height from said solder edge plane;

the ratio of said funnel body height and each said second solder edge height is greater than 2.6;

each of said diagonal straight linear portions and said interface intersect at a respective third interface point;

each said third interface point and a corresponding solder edge corner defining a respective third straight line therebetween;

each said third straight line and each of said diagonal straight linear portions defining a respective third maximum distance therebetween;

each said third maximum distance defining a respective third maximum distance point on said outer surface of said funnel body portion;

each said third maximum distance point is disposed at a respective third solder edge height from said solder edge plane;

the ratio of said funnel body height and each said third solder edge height is greater than 2.5;

where (vi.) is:

said solder edge plane comprises a straight diagonal length;

the ratio of said straight diagonal length and each said first maximum distance is less than 25;

the ratio of said straight diagonal length and each said second maximum distance is greater than 33;

the ratio of said straight diagonal length and each said third maximum distance is greater than 28;

where (vii.) is:

said funnel throat transition portion comprises a portion having a cross-sectional configuration defined by substantially straight portions to connect said cylindrical funnel throat to said rectangular solder edge portion;

said faceplate comprises a recessed peripheral portion;

said solder edge portion comprises an elongated peripheral portion to interlock with said recessed peripheral portion of said faceplate.

5. A wide-angle, shallow-depth cathode ray tube comprising:

a glass faceplate;

said faceplate comprising a substantially flat faceplate with a first surface which becomes an outer surface and substantially the viewing area of said cathode ray tube upon installation, and with a second surface opposite said first surface;

a phosphor screen being disposed adjacent to said second surface, being configured to be responsive to electron beams incident thereon, and being configured to emit visible light on said first surface of said faceplate when excited by electron beams;

an electron gun means being disposed at a distance away from said phosphor screen and being configured to emit electron beams; and a wide-angle, shallow-depth glass funnel;

said glass funnel comprising (a.), (b.), (c.), (d.), and (e.), where (a.), (b.), (c.), (d.), and (e.) are:

(a.) a solder edge portion;

said solder edge portion being soldered to said faceplate, said solder edge portion comprising a substantially rectangular solder edge portion;

(b.) a cylindrical funnel throat portion having said electron gun means mounted therein;

(c.) a funnel body portion comprising a truncated substantially pyramidal funnel body portion, said pyramidal funnel body portion defining a central axis being disposed substantially perpendicular to said solder edge portion, and said pyramidal funnel body portion comprising an outer surface;

(d.) a first transition portion being disposed between said cylindrical funnel throat portion and said pyramidal funnel body portion and forming a funnel throat transition portion; and (e.) a second transition portion being disposed between said pyramidal funnel body portion and said solder edge portion and forming a solder edge transition portion;

said solder edge portion having a first solder edge and a second solder edge joined to said first solder edge;

said first solder edge and said second solder edge being connected to one another at a corner;

said first solder edge comprising a first length, said first length comprising a first midpoint, said first midpoint and said central axis defining a first plane being disposed substantially perpendicular to said solder edge portion;

said second solder edge comprising a second length comprising a second midpoint, said second midpoint and said central axis defining a second plane being disposed substantially perpendicular to said solder edge portion;

said corner and said central axis defining a third plane being disposed substantially perpendicular to said solder edge portion;

the intersection between said first plane and said pyramidal funnel body portion defining a first straight linear portion being disposed on said outer surface of said pyramidal funnel body portion;

the intersection between said second plane and said pyramidal funnel body defining a second straight linear portion on said outer surface of said pyramidal funnel body portion;

the intersection between said third plane and said pyramidal funnel body portion defining a third straight linear portion on said outer surface of said pyramidal funnel body portion;

all of said straight linear portions extending a substantial portion of the distance from said funnel throat transition portion to said solder edge transition portion;

the intersection of said first plane and said solder edge transition portion defining a first height from said solder edge portion to a portion of said first straight linear portion being closest to said solder edge portion;

the intersection of said second plane and said solder edge transition portion defining a second height from said solder edge portion to a portion of said second straight linear portion being closest to said solder edge portion;

the intersection of said third planes and said solder edge transition portion defining a third height from said solder edge portion to a portion of said third straight linear portion being closest to said solder edge portion;

said first height, from said solder edge portion to said portion of said first straight linear portion being closest to said solder edge portion, being greater than either said second height or said third height and being sufficiently great to dispose and configure said first straight linear portion to have the shallowest slope of all of said three straight linear portions;

said glass funnel thus being configured to minimize the height of said funnel body portion;

and to thus configure a wide-angle, shallow-depth, cathode ray tube.

6. The wide-angle, shallow-depth cathode ray tube according to claim 5, wherein:

said first straight linear portion has a first length extending substantially from said funnel throat transition portion to substantially said solder edge transition portion;

said second straight linear portions has a second length;

said first length of said first straight linear portion is longer than said second length of said second straight linear portion.

7. The wide-angle, shallow-depth cathode ray tube according to claim 6, wherein:

said first straight linear portion comprises substantially all of the distance from said solder edge transition portion to said funnel throat transition portion;

said second straight linear portion comprises a portion of the distance from said solder edge transition portion to said funnel throat transition portion;

the ratio of said first straight linear portion to the length between said solder edge transition portion and said funnel throat transition portion comprises a first ratio;

the ratio of said second straight linear portion to the length between said solder edge transition portion and said funnel throat transition portion comprises a second ratio;

said first ratio is greater than said second ratio.

8. The wide-angle, shallow-depth cathode ray tube according to claim 5 comprising all of (i.), (ii.), (iii.), (iv.), (v.), (vi.), (vii.), and (viii.):

where (i.) is:

said first straight linear portion has a first length extending substantially from said funnel throat transition portion to substantially said solder edge transition portion;

said second straight linear portions has a second length;

said first length of said first straight linear portion is longer than said second length of said second straight linear portion;

where (ii.) is:

said solder edge transition portion at said midpoint comprises a curved portion connecting said first straight linear portion to said solder edge portion;

where (iii.) is:

said first straight linear portion has a first wall thickness;

said third straight linear portion has a first wall thickness adjacent to said funnel throat transition portion and has a second wall thickness adjacent to said solder edge transition portion;

said first wall thickness of said first straight linear portion is less than either said first wall thickness of said third straight linear portion or said second wall thickness of said third straight linear portion;

where (iv.) is:

said second straight linear portion has a first wall thickness adjacent to said funnel throat transition portion which is greater than said first wall thickness of said first straight linear portion;

said second straight linear portion has a second wall thickness adjacent to said solder edge transition portion which is greater than said first wall thickness of said first straight linear portion;

said second straight linear portion has a third wall thickness being disposed between said first wall thickness of said second straight linear portion and said second wall thickness of said second straight linear portion;

said third wall thickness of said second straight linear portion is less than either said first wall thickness of said second straight linear portion or said second wall thickness of said second straight linear portion;

where (v.) is:

said solder edge portion defines a solder edge plane;

said funnel body portion and said funnel throat transition portion are joined at an interface;

a distance from said solder edge plane to said interface comprises a funnel body height;

said first straight linear portion and said interface intersect at a first interface point;

said first interface point and said first midpoint defining a first straight line therebetween;

said first straight line and said first straight linear portion defining a first maximum distance therebetween;

said first maximum distance defining a first maximum distance point on said outer surface of said funnel body portion;

said first maximum distance point is disposed at a first solder edge height from said solder edge plane;

the ratio of said funnel body height and said first solder edge height is greater than 1.6;

said second straight linear portion and said interface intersect at a second interface point;

said second interface point and said second midpoint defining a second straight line therebetween;

said second straight line and said second straight linear portion defining a second maximum distance therebetween;

said second maximum distance defining a second maximum distance point on said outer surface of said funnel body portion;

said second maximum distance point is disposed at a second solder edge height from said solder edge plane;

the ratio of said funnel body height and said second solder edge height is greater than 2.6;

said third straight linear portion and said interface intersect at a third interface point;

said third interface point and said solder edge corner defining a third straight line therebetween;

said third straight line and said third straight linear portion defining a third maximum distance therebetween;

said third maximum distance defining a third maximum distance point on said outer surface of said funnel body portion;

said third maximum distance point is disposed at a third solder edge height from said solder edge plane;

the ratio of said funnel body height and said third solder edge height is greater than 2.5;

where (vi.) is:

said solder edge plane comprises a straight diagonal length;

the ratio of said straight diagonal length and said first maximum distance is less than 25;

the ratio of said straight diagonal length and said second maximum distance is greater than 33;

the ratio of said straight diagonal length and said third maximum distance is greater than 28;

where (vii.) is:

said funnel throat transition portion comprises a portion having a cross-sectional configuration defined by substantially straight portions to connect said cylindrical funnel throat to said rectangular solder edge portion;

where (viii.) is:

said faceplate comprises a recessed peripheral portion; and said solder edge portion comprises an elongated peripheral portion to interlock with said recessed peripheral portion of said faceplate.

9. A glass funnel for a cathode ray tube, said glass funnel comprising:

(a.) a solder edge structure;

said solder edge structure being configured to receive a faceplate for a cathode ray tube and said solder edge structure defining a solder edge plane thereat;

(b.) a cylindrical funnel throat configured to mount therein electron gun means of a cathode ray tube;

(c.) a funnel body;

said funnel body having an outer surface and said funnel body defining a central axis being disposed substantially perpendicular to said solder edge plane;

(d.) a first, funnel throat, transition portion disposed between said cylindrical funnel throat and said funnel body; and (e.) a second, solder edge, transition portion disposed between said funnel body and said solder edge structure;

said solder edge structure having a first substantially linear solder edge and a second substantially linear solder edge joining said first substantially linear solder edge;

said first substantially linear solder edge being disposed transverse to said second substantially linear solder edge;

said first substantially linear solder edge and said second substantially linear solder edge being connected to one another at a corner;

said first substantially linear solder edge comprising a first length comprising a first midpoint;

a first region extending from said first midpoint towards said central axis across said solder edge transition portion and across said funnel body to said funnel throat transition portion;

said first region comprising a first substantially straight linear portion being disposed on said outer surface of said funnel body;

said second substantially linear solder edge comprising a second length comprising a second midpoint;

a second region extending from said second midpoint towards said central axis across said solder edge transition portion and across said funnel body to said funnel throat transition portion;

said second region comprising a second substantially straight linear portion being disposed on said outer surface of said funnel body;

a third region extending from said corner towards said central axis across said solder edge transition portion and across said funnel body to said funnel throat transition portion; and said third region comprising a third, diagonal, substantially straight linear portion being disposed on said outer surface of said funnel body.

10. The glass funnel according to claim 9, wherein:

said solder edge transition portion, at least at said first region, from said first substantially straight linear portion to said first solder edge midpoint, is sufficiently high, at a portion of said first substantially straight linear portion being closest to said solder edge plane, to configure said first substantially straight linear portion to have the shallowest steepness of all of said three substantially straight linear portions; and all of said substantially straight linear portions extending a substantial portion of the distance from said funnel throat transition portion to said solder edge transition portion.

11. The glass funnel according to claim 10, wherein:

said first substantially straight linear portion has a first length extending substantially from said funnel throat transition portion to substantially said solder edge transition portion;

said second substantially straight linear portion has a second length extending substantially from said funnel throat transition portion to substantially said solder edge transition portion;

said first length of said first substantially straight linear portion is longer than said second length of said second substantially straight linear portion.

12. The glass funnel according to claim 11, wherein:

said solder edge transition portion at least at said first region comprises a curved portion connecting said first substantially straight linear portion to said solder edge structure.

13. The glass funnel according to claim 12, wherein:

said first substantially straight linear portion has a first wall thickness;

said third substantially straight linear portion has a first wall thickness adjacent to said funnel throat transition portion and has a second wall thickness adjacent to said solder edge transition portion;

said first wall thickness of said first substantially straight linear portion is less than either said first wall thickness of said third substantially straight linear portion or said second wall thickness of said third substantially straight linear portion.

14. The glass funnel according to claim 13, wherein:

said second substantially straight linear portion has a first wall thickness adjacent to said funnel throat transition portion which is greater than said first wall thickness of said first substantially straight linear portion;

said second substantially straight linear portion has a second wall thickness adjacent to said solder edge transition portion which is greater than said first wall thickness of said first substantially straight linear portion; and said second substantially straight linear portion has a third wall thickness being disposed between said first and wall thickness of said second substantially straight linear portion and said second wall thickness of said second substantially straight linear portion;

said third wall thickness of said second substantially straight linear portion is less than either said first wall thickness of said second substantially straight linear portion or said second wall thickness of said second substantially straight linear portion.

15. The glass funnel according to claim 14, wherein:

said funnel body and said funnel throat transition portion are joined at an interface;

a distance from said solder edge plane to said interface along said central axis comprises a funnel body height;

said first region and said interface intersect at a first interface point;

said first interface point and said first solder edge midpoint defining a first straight line therebetween;

said first straight line and said first region defining a first maximum distance therebetween;

said first maximum distance defining a first maximum distance point on said outer surface of said funnel body;

said first maximum distance point being disposed at a first solder edge height from said solder edge plane;

the ratio of said funnel body height and said first solder edge height is greater than 1.6;

said second region and said interface intersect at a second interface point;

said second interface point and said second solder edge midpoint defining a second straight line therebetween;

said second straight line and said second region defining a second maximum distance therebetween;

said second maximum distance defining a second maximum distance point on said outer surface of said funnel body;

said second maximum distance point being disposed at a second solder edge height from said solder edge plane;

the ratio of said funnel body height and said second solder edge height is greater than 2.6;

said third region and said interface intersect at a third interface point;

said third interface point and said corner defining a third straight line therebetween;

said third straight line and said third region defining a third maximum distance therebetween;

said third maximum distance defining a third maximum distance point on said outer surface of said funnel body;

said third maximum distance point is disposed at a third solder edge height from said solder edge plane; and the ratio of said funnel body height and said third solder edge height is greater than 2.5.

16. The glass funnel according to claim 15, wherein:

said solder edge plane comprises a straight diagonal length;

the ratio of said straight diagonal length and said first maximum distance is less than 25;

the ratio of said straight diagonal length and said second maximum distance is greater than 33; and the ratio of said straight diagonal length and said third maximum distance is greater than 28.

17. The glass funnel according to claim 16, wherein:

said solder edge structure comprises a substantially at rectangular solder edge structure;

said funnel throat transition portion comprises a portion having a cross-sectional configuration defined by substantially straight portions to connect said cylindrical funnel throat to said rectangular solder edge structure.

18. The glass funnel according to claim 17, wherein:

said solder edge structure is configured to interlock with a faceplate comprising a recessed peripheral portion; and said solder edge structure comprises an elongated peripheral portion to interlock with said recessed peripheral portion of said faceplate.

19. The glass funnel according to claim 9, wherein:

said first substantially straight linear portion comprises substantially all of the distance from said solder edge transition portion to said funnel throat transition portion;

said second substantially straight linear portion comprises a portion of the distance from said solder edge transition portion to said funnel throat transition portion;

the ratio of said first substantially straight linear portion to the length of said first region between said solder edge transition portion and said funnel throat transition portion comprises a first ratio;

the ratio of said second substantially straight linear portion to the length of said second region between said solder edge transition portion and said funnel throat transition portion comprises a second ratio;

said first ratio is greater than said second ratio.

* * * * *

UNITED STATES PATENT AND TRADEMARK OFFICE

CERTIFICATE OF CORRECTION

PATENT NO. : 6,680,566 B2
DATED : January 20, 2004
INVENTOR(S) : Stefan Hergott et al.

It is certified that error appears in the above-identified patent and that said Letters Patent is hereby corrected as shown below:

Column 9,
Line 17, after "(D)", delete "$D/H_{\alpha ia} \succ 28$." and insert -- $D/H_{dia} \succ 28$. --.

Column 17,
Lines 54 and 59, after "Oliver" delete "M".
Line 55, before "and", delete "ÜHLKE," and insert -- MÜHLKE, --.
Line 60, before the first occurrence of "as", delete "ÜHLKE," and insert -- MÜHLKE, --.

Column 23,
Line 12, after "funnel", delete "(19," and insert -- (10, --.

Column 25,
Line 49, after "(iii.),", delete "(iv.)x" and insert -- (iv.), --.

Column 48,
Line 28, after "substantially" delete "at".

Signed and Sealed this

Twenty-second Day of March, 2005

JON W. DUDAS
*Director of the United States Patent and Trademark Office*